US007992955B2

(12) United States Patent
Takata

(10) Patent No.: US 7,992,955 B2
(45) Date of Patent: Aug. 9, 2011

(54) LIQUID DISCHARGING DEVICE

(75) Inventor: Masayuki Takata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 412 days.

(21) Appl. No.: 12/203,063

(22) Filed: Sep. 2, 2008

(65) Prior Publication Data

US 2009/0058917 A1 Mar. 5, 2009

(30) Foreign Application Priority Data

Aug. 31, 2007 (JP) ..... 2007-225424

(51) Int. Cl.
*B41J 29/377* (2006.01)
*B41J 2/175* (2006.01)

(52) U.S. Cl. ..... 347/18; 347/85

(58) Field of Classification Search ..... 347/18, 347/84, 85, 89
See application file for complete search history.

(56) References Cited

U.S. PATENT DOCUMENTS 5,790,157 A * 8/1998 Higuma et al. ..... 347/85
7,597,434 B2 * 10/2009 Nitta et al. ..... 347/89
2006/0170739 A1 * 8/2006 Koga et al. ..... 347/85

FOREIGN PATENT DOCUMENTS

JP H02-111555 A 4/1990
JP H10-291300 A 11/1998

* cited by examiner

*Primary Examiner* — Geoffrey Mruk
(74) *Attorney, Agent, or Firm* — Baker Botts L.L.P.

(57) ABSTRACT

A liquid discharging device is provided. The liquid discharging device includes a sub coolant tank that is held by a carriage and stores a coolant for cooling a discharge head; and a coolant replacement portion that includes a main coolant tank which can communicate with the sub coolant tank, and replaces the coolant in the sub coolant tank with a coolant in the main coolant tank when the main coolant tank communicates with the sub coolant tank. The sub coolant tank does not communicate with the main coolant tank when the carriage is disposed at a liquid discharge position, and the sub coolant tank communicates with the main coolant tank when the carriage is disposed at a liquid refill position.

17 Claims, 20 Drawing Sheets

LIQUID DISCHARGING DEVICE

CROSS REFERENCE TO RELATED APPLICATION

The present application claims priority from Japanese Patent Application No. 2007-225424, which was filed on Aug. 31, 2007, the disclosure of which is herein incorporated by reference in its entirety.

TECHNICAL FIELD

Devices consistent with the present invention relate to a liquid discharging device that discharges a liquid onto a recording medium, and more particularly, to a liquid discharging device of a so-called station supply type.

BACKGROUND

For example, related art liquid discharging devices, such as ink jet printers, include a discharge head that discharges a liquid and a carriage that holds the discharge head and can reciprocate. When the carriage is disposed at a liquid discharge position, the liquid discharging device discharges the liquid from the discharge head onto a recording medium to print images or characters on the recording medium. A main liquid tank that stores a liquid therein is detachably mounted to a main body of the device. For example, a tube supply type and a station supply type are used to supply a liquid from the main liquid tank to the discharge head.

Japanese unexamined patent application publication No. H10-291300 (hereinafter called JP H10-291300) describes a related art tube-supply-type liquid discharging device. In the related art liquid discharging device, a main liquid tank mounted to a main body is connected to a discharge head by a tube at all times. When a liquid is discharged from the discharging head, the liquid stored in the main liquid tank is supplied to the discharge head through the tube.

Japanese unexamined patent application publication No. H02-111555 (hereinafter called JP H02-111555) describes a related art station-supply-type liquid discharging device. The related art liquid discharging device includes a sub liquid tank that is held by a carriage. When the carriage is disposed at a liquid discharge position, the sub liquid tank does not communicate with a main liquid tank, and the liquid in the sub liquid tank is supplied to the discharge head. Under a condition that the amount of liquid remaining in the sub liquid tank is less than or equal to a predetermined value, the carriage is moved to a liquid refill position that is different from the liquid discharge position to make the sub liquid tank communicate with the main liquid tank, thereby refill the sub liquid tank with the liquid stored in the main liquid tank.

As such, in the tube supply type, the liquid discharge operation and the liquid supply operation are performed at the same time, and in the station supply type, since a a space for arranging the tube is not provided, it is possible to reduce the overall size of a liquid discharging device.

However, the discharge head of the related art liquid discharging device includes discharge nozzles, pressure chambers that communicate with the discharge nozzles, and a pressure applying unit that applies a discharge pressure to the liquid in the pressure chambers (for example, a piezoelectric actuator or a heating element). A substrate having an integrated circuit for driving the pressure applying unit mounted thereon is provided on the carriage. In recent years, the number of driving channels has increased, and a driving frequency has increased, regardless of the liquid supply type, in order to meet the demands for high resolution and high printing speed. Accordingly, the amount of heat generated from the discharge head has increased due to an increase in the heat generated by the internal resistance of the integrated circuit. When the heat is accumulated, the temperature of liquid increases while the liquid passes through the vicinity of the integrated circuit, and the viscosity of the liquid varies, which results in a variation in the discharge amount of liquid or the discharge speed of liquid from the discharge nozzles corresponding to the applied discharge pressure. Therefore, printing accuracy is lowered. In order to solve this problem, a structure has been proposed in which a heat sink formed of, for example, a metal plate, which is provided in the carriage. However, in this case, it is necessary to increase the size of the heat sink as the amount of heat generated is increased. As a result, the overall size of a carriage increases.

JP H10-291300 also describes a related art device that cools around the discharge head. The related art cooling device includes a coolant reservoir that is provided in a main body of the liquid discharging device and stores a coolant, a coolant circulating path which connects an inlet of the coolant reservoir and an outlet of the coolant reservoir through which the coolant passes, and a pump that pressurizes the coolant in the coolant circulating path to circulate the coolant. In addition, a portion of the coolant circulating path passes around the discharge head. According in the related art cooling device, since the discharge head is water-cooled, there is no variation in the viscosity of liquid, and it is possible to prevent printing accuracy from being lowered. In addition, it is possible to avoid an increase in the size of a heat sink and thus prevent an increase in the size of a carriage.

SUMMARY

The above described related art devices have a few disadvantages. For example, according to the cooling device described in JP H10-291300, the coolant circulating path is provided so as to reciprocate between the coolant reservoir of the main body of the liquid discharging device and the periphery of the discharge head of the carriage, and the coolant circulating path is lengthened with the movement of the carriage. Therefore, the coolant circulating path should be provided so as not to hinder the movement of the carriage. However, since the liquid discharging device is a tube supply type, the arrangement of the tube should also be considered. As a result, the structure of the device becomes complicated.

Moreover, when a cooling device is applied to the related art station-supply-type liquid discharging device described in JP H02-111555, it is necessary to ensure a space for the coolant circulating path. Accordingly, the advantage of the station supply type liquid discharging device, i.e., not requiring a space for arranging the tube, is lost. Therefore, it is difficult to reduce the size of a device while using the station supply type.

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the invention to provide a liquid discharging device that includes a water cooling device and can maintain the advantages of a station supply type.

According to an exemplary embodiment of the present invention, there is provided a liquid discharging device comprising a discharge head that discharges a liquid; a carriage that is movable and holds the discharge head; a sub liquid tank that is held by the carriage and stores the liquid supplied to the discharge head; a liquid refill portion that refills the sub liquid tank with the liquid and includes a main liquid tank that can communicate with the sub liquid tank; a carriage movement control unit that moves the carriage within a range including a liquid discharge position where the discharge head discharges the liquid onto a recording medium and a liquid refill position where the sub liquid tank communicates with the main liquid tank; a liquid refill control unit that controls the operation of the liquid refill portion; a sub coolant tank that is held by the carriage and stores a coolant for cooling the discharge head; and a coolant replacement portion that includes a main coolant tank which can communicate with the sub coolant tank, and replaces the coolant in the sub coolant tank with a coolant in the main coolant tank when the main coolant tank communicates with the sub coolant tank, wherein the sub coolant tank does not communicate with the main coolant tank when the carriage is disposed at the liquid discharge position, and the sub coolant tank communicates with the main coolant tank when the carriage is disposed at the liquid refill position.

According to another exemplary embodiment of the present invention, there is provided a liquid discharging device. The liquid discharging device includes a moveable carriage comprising a discharge head which discharges a liquid, a sub-liquid tank which stores the liquid for discharge, and a sub-coolant tank which stores a coolant for cooling the discharge head, the moveable carriage moving within a range comprising a discharge position at which the discharge head discharges the liquid onto a recording medium and a refill position at which the sub-liquid tank and the sub-coolant tank are refilled with the liquid and the coolant, respectively. The liquid discharge device also includes a refill unit comprising a main liquid tank, and a main coolant tank, and the sub-liquid tank and the sub-coolant tank of the carriage and the main liquid tank and the main coolant tank of the stationary refill unit only communicate with each other, respectively, when the carriage is in the refill position.

BRIEF DESCRIPTION OF THE DRAWINGS

Illustrative aspects of the invention will be described in detail with reference to the following figures wherein:

FIG. 8 is a diagram schematically illustrating a variation in states of the image recording unit and the coolant replacement unit during the coolant replacement process according to the first exemplary embodiment.

DETAILED DESCRIPTION OF EXEMPLARY EMBODIMENTS OF THE PRESENT INVENTION

Hereinafter, exemplary embodiments of the invention will be described in detail with reference to the accompanying drawings.

Figure 1:
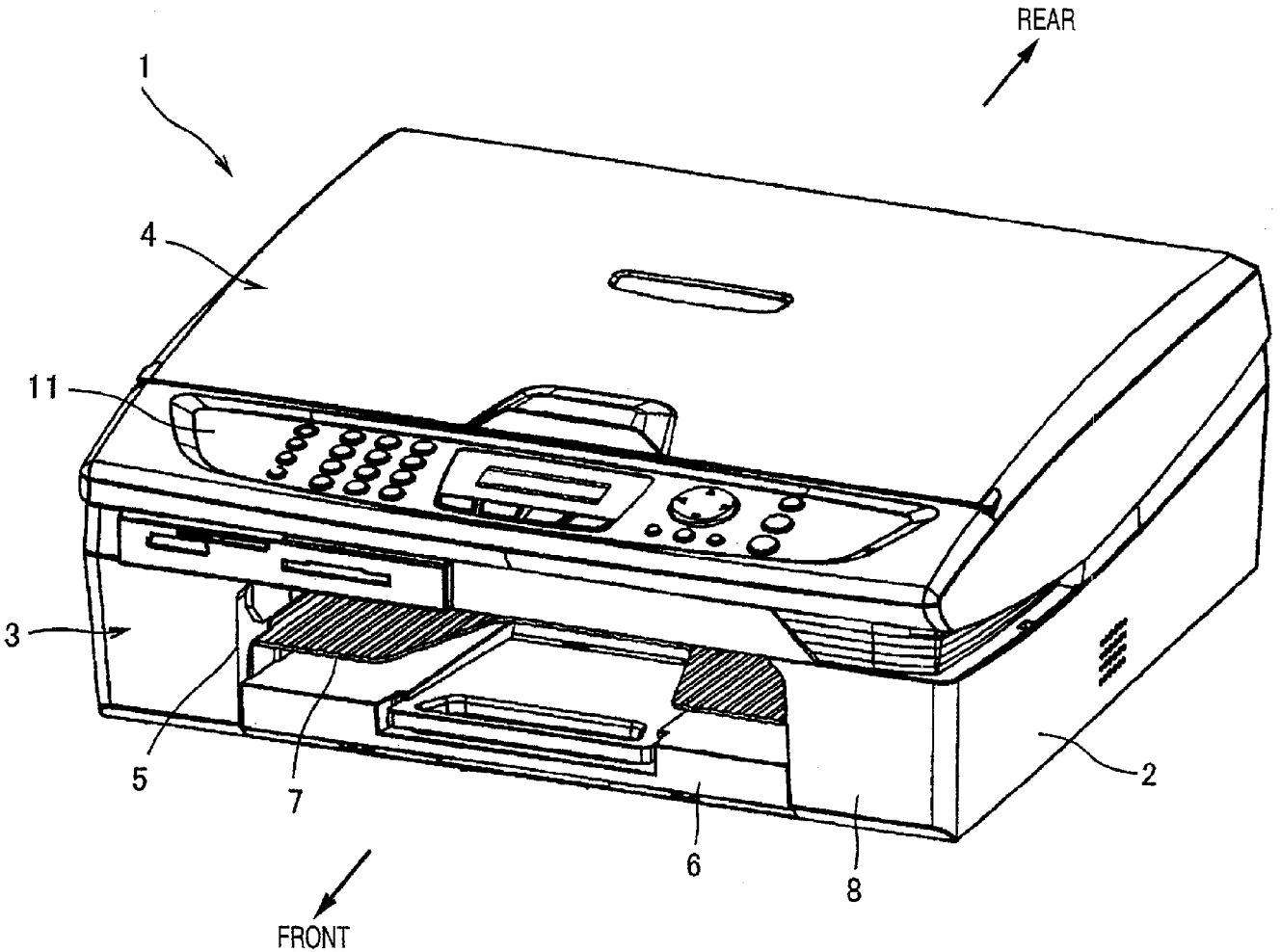
FIG. 1 is perspective view illustrating an external structure of a multi-function machine according to first to third exemplary embodiments of the present invention.

FIG. 1 is a perspective view illustrating the external structure of a multi-function machine 1 provided with a printer unit 3 according to a first exemplary embodiment of the invention. The printer unit 3 is an example of a liquid discharging device. As shown in FIG. 1, the multi-function machine 1 has multiple functions, such as a printer function, a scanner function, a copy function, and a facsimile function, and includes a housing 2 having a substantially square shape, which is a portion of a main body of the machine. The printer unit 3 (liquid discharging device) that performs ink jet printing is provided at a lower part of the housing 2, and a scanner unit 4 is provided at an upper part of the housing 2. An opening 5 is formed at a lower portion of the front surface of the housing 2, and a sheet feed tray 6 and a sheet discharge tray 7 capable of accommodating recording sheets (recording media) are provided in the opening 5 on top of each other in the vertical direction. A door 8 is openably provided at the lower right side of the front surface of the housing 2, and a cartridge mounting portion 9 (see FIG. 2) is provided on the rear side of the door 8 inside the housing 2. When the door 8 is opened, the cartridge mounting portion 9 is exposed to the front side such that an ink cartridge (a main liquid tank) 10 (see FIG. 2) having ink (liquid) stored therein can be inserted into or removed from the cartridge mounting portion 9. A control panel 11 for controlling the operation of the multi-function machine 1 is provided at an upper part of the front surface of the housing 2. In addition, the multi-function machine 1 is configured such that the multi-function machine 1 can be connected to an external information apparatus 12 (see FIG. 6), such as a personal computer. The printer unit 3 of the multi-function machine 1 is configured to print images or characters on the recording sheet on the basis of data transmitted from, for example, the control panel 11, the external information apparatus 12, or the scanner unit 4.

Figure 2:
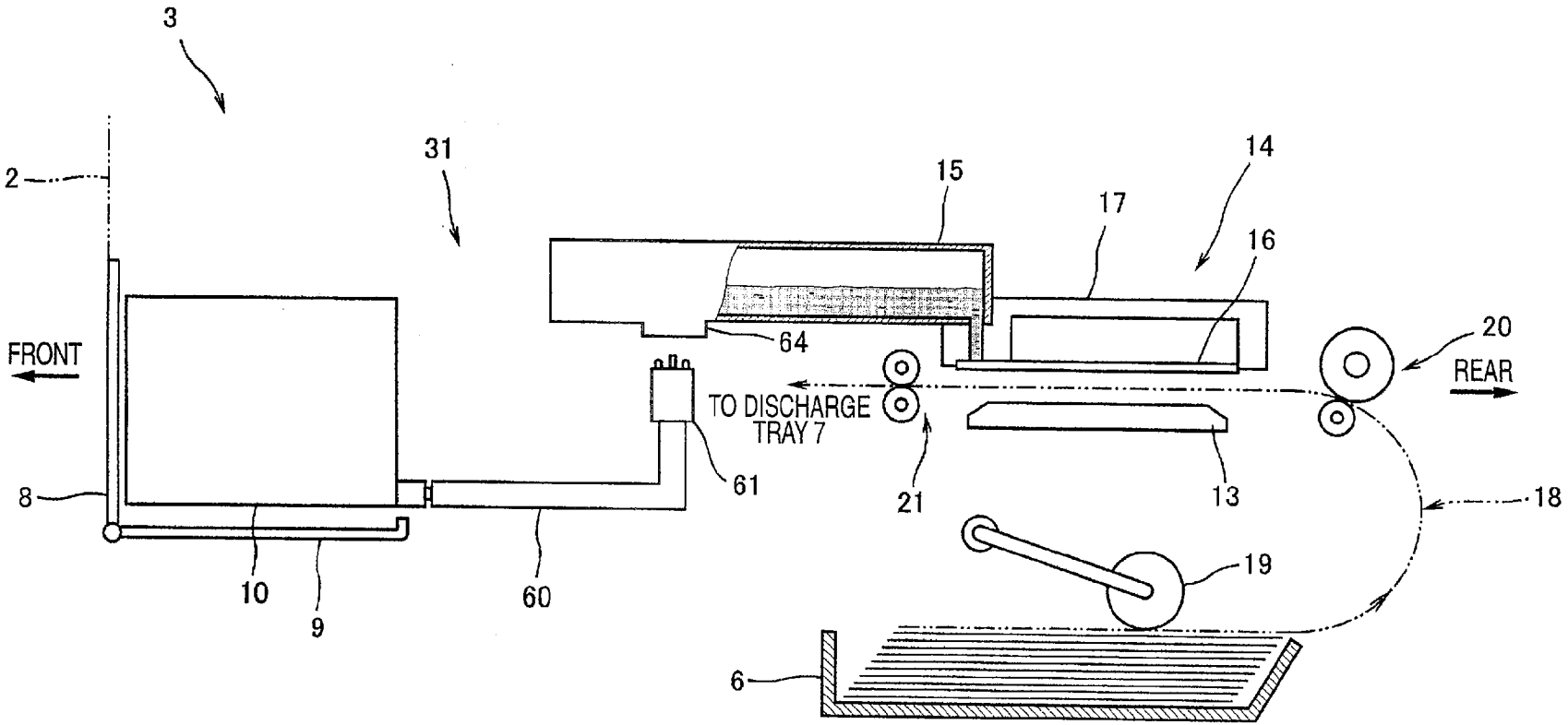
FIG. 2 is a side view schematically illustrating a structure of a printer unit according to the first exemplary embodiment.

FIG. 2 is a cross-sectional view schematically illustrating the structure of the printer unit 3. As shown in FIG. 2, a platen 13 is provided above the sheet feed tray 6 inside the housing 2, and an image recording unit 14 is provided above the platen 13. The image recording unit 14 includes a carriage 17 provided with, for example, a sub ink tank 15 that can store ink supplied from the ink cartridge 10 and a discharge head 16 that discharges the ink supplied from the ink cartridge 10 through the sub ink tank 15.

A sheet transport path 18 through which the recording sheet is transported is provided on the rear side of the sheet feed tray 6 in the front view of the printer unit. The sheet transport path 18 is formed in a curved shape such that the recording sheet loaded on the sheet feed tray 6 is sequentially transported in the backward, upward, and forward directions and then passes between the platen 13 and the image recording unit 14 to reach the sheet discharge tray 7. A sheet feed roller 19 that feeds the recording sheet in the sheet feed tray 6 to the sheet transport path 18 is provided immediately above the sheet feed tray 6. A pair of transport rollers 20 is provided on the rear side of the platen 13 so as to interpose the sheet transport path 18 therebetween in the vertical direction. A pair of sheet discharge rollers 21 is provided on the front side of the platen 13 so as to interpose the sheet transport path 18 therebetween in the vertical direction. Therefore, the recording sheet in the sheet feed tray 6 is fed to the sheet transport path 18 by the sheet feed roller 19, and then transported between the platen 13 and the image recording unit 14 by the pair of transport rollers 20. Then, the sheet is transported from the sheet transport path 18 to the sheet discharge tray 7 by the pair of sheet discharge rollers 21.

Figure 3:
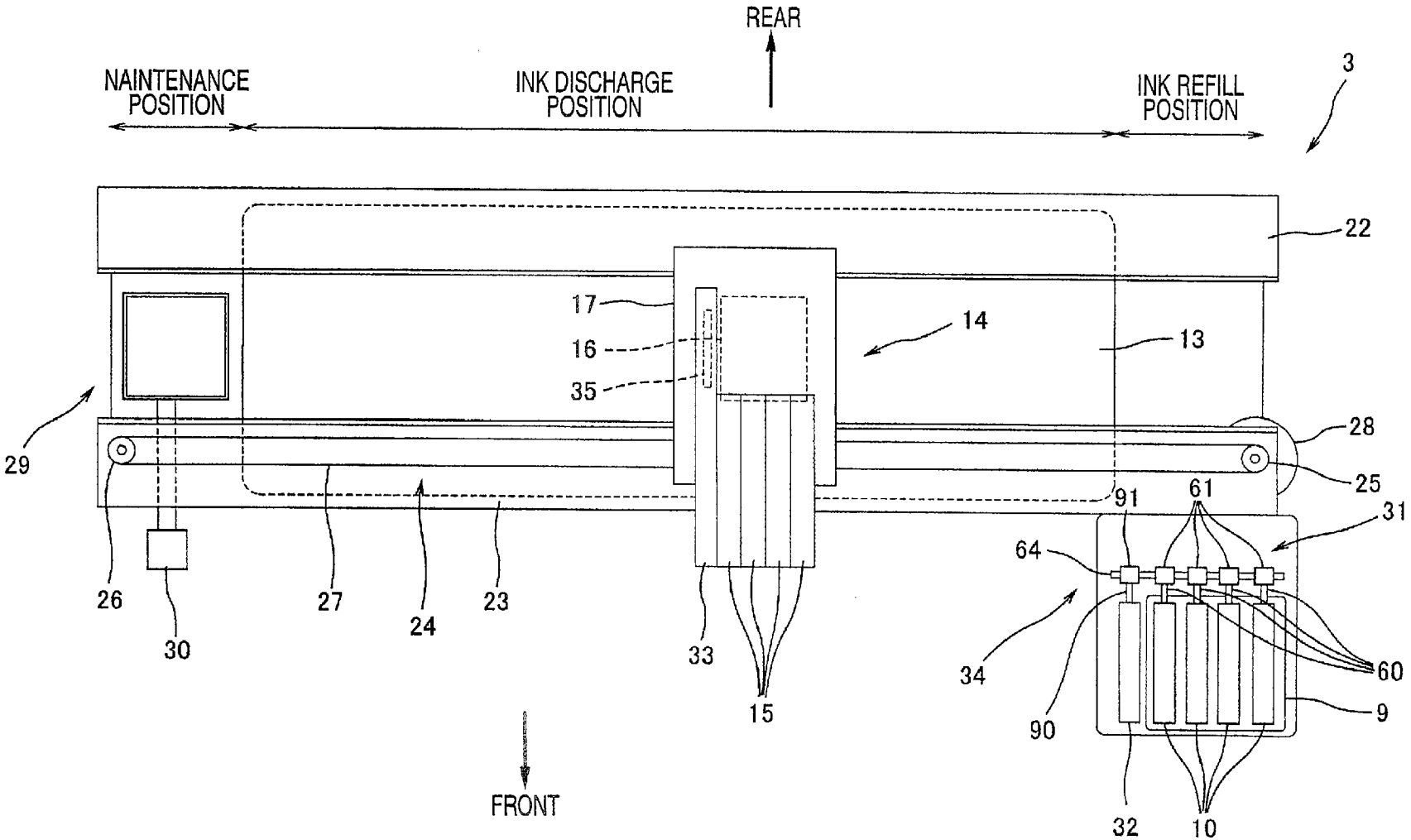
FIG. 3 is a plan view schematically illustrating the structure of the printer unit according to the first exemplary embodiment.

FIG. 3 is a plan view schematically illustrating the structure of the printer unit 3. As shown in FIG. 3, front and rear guide rails 22 and 23, which are portions of a frame for supporting components of the printer unit 3 and extend in the right-left direction, are provided above the platen 13. The carriage 17 of the image recording unit 14 is supported by these guide rails 22 and 23, and can slidably reciprocate above the platen 13 in the direction in which the guide rails 22 and 23 extend (i.e., the right-left direction). A belt driving mechanism 24 is provided on the upper surface of the guide rail 23. The belt driving mechanism 24 is formed by winding an endless timing belt 27 having sawteeth formed on the inner surface thereof around a driving pulley 25 and a driven pulley 26 that are provided substantially in the vicinities of both ends of the guide rail 23 in the right-left direction. A carriage motor 28 is connected to a shaft of the driving pulley 25, and the driving pulley 25 is rotated by the driving force of the carriage motor 28. When the driving pulley 25 is rotated, the timing belt 27 is rotated by the driving pulley 25 and the driven pulley 26. The bottom of the carriage 17 is fixed to the timing belt 27. Therefore, when the timing belt 27 is rotated, the carriage 17 reciprocates on the guide rails 22 and 23 in the right-left direction.

In the scanning range of the carriage 17, a region above the platen 13 is an ink discharge position (liquid discharge position). The ink discharge position of the printer unit 3 has a range corresponding to at least the width of the recording sheet, and the carriage 17 can reciprocate in this range. When the carriage 17 is at the ink discharge position, ink is discharged on the recording sheet that is transported onto the upper surface of the platen 13 through the sheet transport path 18 (see FIG. 2), thereby printing an image on the recording sheet.

A maintenance mechanism 29 is provided on the left side of the platen 13. In the scanning range of the carriage 17, a region on the left side of the ink discharge position serves as a maintenance position. When the carriage 17 is at the maintenance position, the discharge head 16 is disposed above the maintenance mechanism 29, and the maintenance mechanism 29 sucks ink from the discharge head 16 using negative pressure to keep an ink passage of the discharging head 16 in proper condition. The maintenance mechanism 29 is provided with a liquid waste foam 30 that is made of a hygroscopic material, such as poly urethane. The ink sucked by negative pressure is absorbed by the liquid waste foam 30.

In the scanning range of the carriage 17, a region on the right side of the ink discharge position serves as an ink refill position (liquid refill position). The ink cartridge 10 mounted to the cartridge mounting portion 9 is arranged on the right side of the platen 13. The printer unit 3 according to the first exemplary embodiment can use four color inks (e.g., cyan, magenta, yellow, and black) to perform full color printing. Four ink cartridges 10 storing the four color inks are mounted to the cartridge mounting portion 9 so as to be arranged in the right-left direction. In addition, four sub ink tanks 15 corresponding to the four color inks are provided in the carriage 17. The printer unit 3 is provided with ink refill portions (liquid refill portions) 31 that allow the ink cartridges 10 to communicate with the corresponding sub ink tanks 15 to refill the sub ink tanks 15 with ink.

In the printer unit 3, the periphery of the discharge head 16 can be water-cooled, and a main coolant tank 32 that stores a coolant for water cooling is provided adjacent to the cartridge mounting portion 9. A sub coolant tank 33 capable of storing a coolant is provided in the carriage 17. The printer unit 3 is provided with a coolant replacement portion 34 that allows the main coolant tank 32 to communicate with the sub coolant tank 33 and replaces the coolant in the sub coolant tank 33 with the coolant in the main coolant tank 32.

When the carriage 17 is at the ink refill position, the ink refill portion 31 is operated to communicate the ink cartridge 10 with the sub ink tank 15, thereby refilling the sub ink tank 15 with ink. In addition, the coolant replacement portion 34 is operated to communicate the main coolant tank 32 with the sub coolant tank 33, thereby replacing the coolant in the sub coolant tank 33 with the coolant in the main coolant tank 32.

The coolant is not particularly limited, but includes, for example, water. Additionally, the water may be combined with a preservative, such as paraben, and a high melting point liquid for preventing evaporation, such as glycerin. In addition, fine capsules, each having a phase-change material that is subjected to solid-liquid phase transition at a temperature (for example, about 60 to about 80° C.) that is equal to or higher than the environmental temperature in the periphery of the discharge head 16, may be mixed with the coolant. It is possible to consume the heat around the discharge head 16 with the latent heat of solution of a phase-change material by appropriately selecting a phase-change material according to cooling conditions. In this way, it is possible to increase the heat capacity of a coolant and thus improve cooling. Therefore, it is possible to obtain a sufficient cooling effect even when the volume of the sub coolant tank 33 is reduced. As a result, it is possible to reduce the weight and size of the carriage 17.

Figure 4:
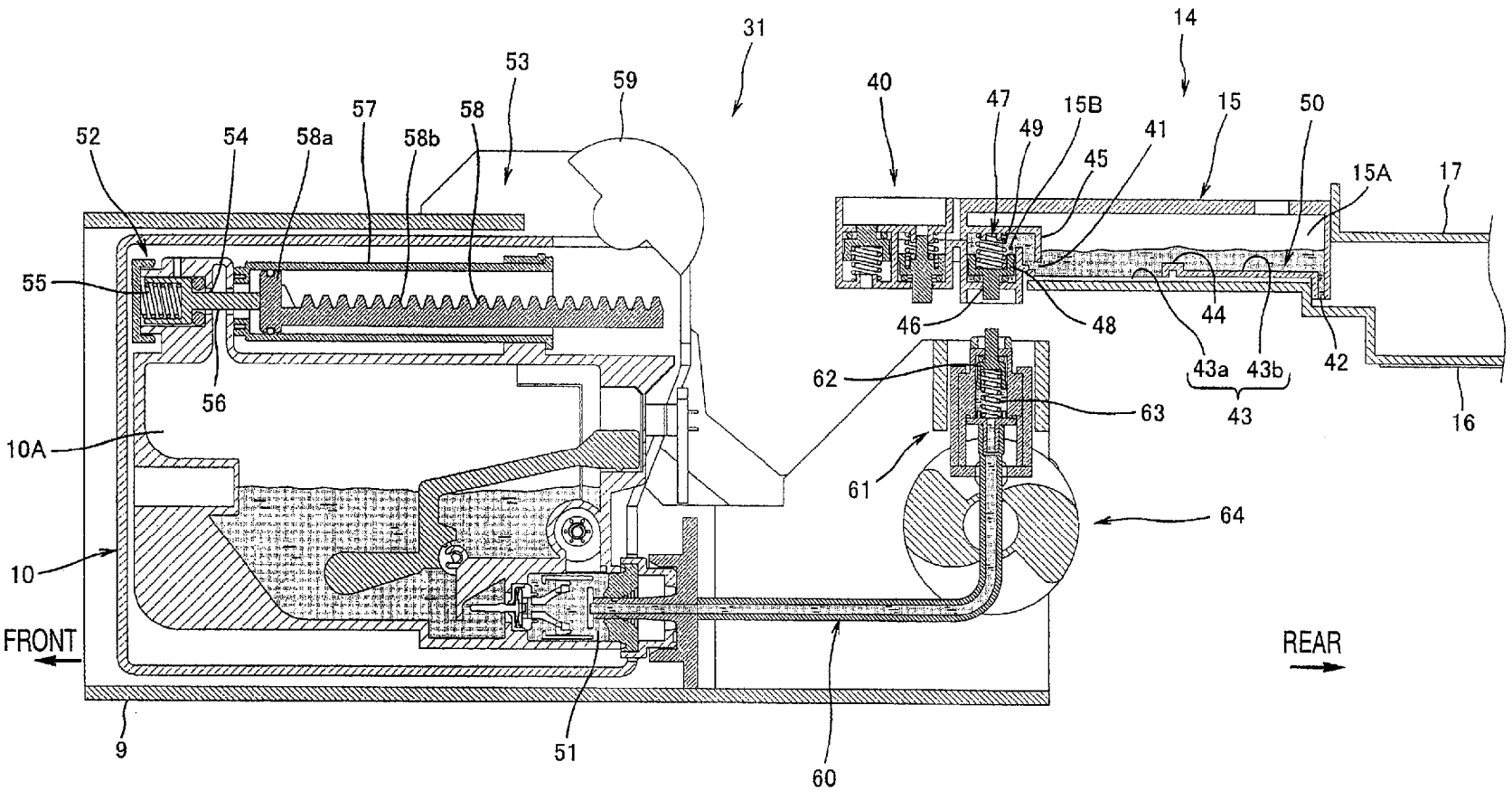
FIG. 4 is a cross-sectional view illustrating a structure of an image recording unit and an ink refill portion according to the first exemplary embodiment.

FIG. 4 is a cross-sectional view illustrating the structure of the image recording unit 14 and the ink refill portion 31 when the carriage 17 is disposed at the ink refill position. The four ink cartridges 10 and the four sub ink tanks 15 have the same structure, and thus only one of the four ink cartridges 10 and the four sub ink tanks 15 is shown in FIG. 4 and will be described below as an example.

The discharge head 16 of the image recording unit 14 includes a cavity unit (not shown) having an ink passage therein and a piezoelectric actuator (not shown) that uses a converse piezoelectric effect to change the volume of the ink passage, thereby applying discharge pressure to the ink in the ink passage. The discharge head 16 discharges the ink to which the discharge pressure is applied from nozzles, which are downstream-side openings of the ink passage. As shown in FIG. 4, the discharge head 16 is attached to the outer bottom of the carriage 17, with a surface of the cavity unit having the nozzles formed therein facing downward. In addition, the carriage 17 includes an IC chip 35 (see FIGS. 2 and 5) provided with a discharge head driving circuit 97 (see FIG. 6) for driving the piezoelectric actuator and a wiring substrate 36 (see FIG. 5) having the IC chip 35 mounted thereon.

The sub ink tank 15 has a square shape that is elongated in the front-back direction in a rear view, and includes a sub ink chamber 15A having a volume, a first communicating hole 41 that is formed in the front surface of the sub ink chamber 15A, and a second communicating hole 42 that is formed in the rear surface of the sub ink chamber 15A. A protruding portion 44 is provided at the center of the bottom 43 of the sub ink chamber 15A in the front-back direction so as to protrude in the right-left direction.

A partition plate 45 that partitions the inside of the sub ink tank 15 into the sub ink chamber 15A and the refill chamber 1 SB is provided in a front portion of the sub ink tank 15. The first communicating hole 41 is formed by a gap between an end portion of the partition plate 45 and a portion of the bottom 43 on the front side of the protruding portion 44 (which is referred to as a first bottom 43*a*). A refill port 46 that communicates with the outside is formed at a lower part of the refill chamber 15B. The refill chamber 15B has therein a refill port valve 47 that allows the sub ink chamber 15A to communicate with the main ink chamber 10A of an external ink cartridge 10 during ink refill. The refill port valve 47 includes a valve body 48 that is inserted into the refill port 46 so as to be movable in the up-down direction and a coil spring 49 that urges the valve body 48 downward. When no external force is applied to the valve body 48, the refill port 46 is closed by the urging force of the coil spring 49. When an external force is applied to the valve body 48 from the lower side to move the valve body 48 upward against the urging force of the coil spring 49, the refill port 46 is opened such that the sub ink chamber 15A communicates with the outside.

The second communicating hole 42 is formed in a portion of the bottom 43 on the rear side of the protruding portion 44 (which is referred to as a second bottom 43*b*) and communicates with an upstream-side opening of the ink passage of the discharge head 16 that extends downward from the communicating hole 42. Therefore, ink in the sub ink chamber 15A is supplied to the discharge head 16 through the second communicating hole 42. An ink remaining portion (liquid remaining portion) 50 is formed by the protruding portion 44, the second bottom 43*b*, and the side surface of the sub ink chamber 15A. The ink remaining portion 50 can be used to make ink remain in the second communicating hole 42 and in the vicinity thereof even when the amount of ink remaining in the sub ink tank 15 is reduced. In FIG. 4, a pressure adjusting portion 40 is also provided. The pressure adjusting portion 40 adjusts the internal pressure of the sub ink chamber 15A.

The ink cartridge 10 has a main ink chamber 10A therein, and an ink supply port 51 that makes the main ink chamber 10A communicate with the outside is provided in the bottom and the rear surface of the ink cartridge 10. In addition, a relief valve 52 and a pump 53 (liquid pump unit) are provided at an upper part of the main ink chamber 10A. The relief valve 52 includes a valve body 54 and a coil spring 55 that urges the valve body 54. A pushrod 56 extends backward from the end surface of the valve body 54 of the refill value 52 to the pump 53. The pump 53 includes a cylinder 57, a piston 58 provided in the cylinder 57, and a pinion 59 that drives the piston 58. The piston 58 includes a piston crown 58*a* that is engaged with the inner surface of the cylinder 57 and a lock gear 58*b* that extends from the piston crown 58*a* backward and is engaged with the pinion 59. When the pinion 59 is rotated, the piston 58 reciprocates in the cylinder 57 in the front-back direction. At that time, the piston crown 58*a* air-tightly slides on the inner surface of the cylinder 57 to change the volume of the main ink chamber 10A. In addition, a hole having a small diameter is formed in one end surface of the cylinder 57, and the pushrod 56 extends up to the inside of the cylinder 57 through the hole. Therefore, when the pinion 58 is moved forward, the piston crown 58*a* moves the pushrod 56 to press the valve body 54 of the relief valve 52 forward, thereby opening the relief valve 52.

A joint valve 61 is connected to the ink supply port 51 through an ink tube 60 that is provided outside the ink cartridge 10. The joint valve 61 includes a valve body 62 that is movable in the up-down direction and a coil spring 63 that urges the valve body 62 upward. When no external force is applied to the valve body 62, the joint valve 61 is closed by the urging force of the coil spring 63. When external force is applied to the valve body 62 to move the valve body 62 downward against the urging force of the coil spring 63, the ink tube 60 and the joint valve 61 are opened such that the main ink chamber 10A communicates with the outside. The joint valve 61 is moved in the up-down direction by a lift mechanism 64.

Therefore, when the image recording unit 14 is at the ink refill position and the lift mechanism 64 lifts up the joint valve 61, the valve body 62 of the joint valve 61 and the valve body 48 of the refill port valve 47 are pressed against each other. When the driving force of the lift mechanism 64 is stronger than the urging force of the coil springs 49 and 63 of the two valves 47 and 61, respectively, the two valves 47 and 61 are opened. As a result, the main ink chamber 10A of the ink cartridge 10 communicates with the sub ink chamber 15A of the sub ink tank 15.

In the first exemplary embodiment, among the above-mentioned structure, the ink refill portion 31 includes the ink cartridge 10 having the main ink chamber 10A and the pump 53, the ink tube 60, the joint valve 61, the lift mechanism 64, and a pinion driving circuit 99 (see FIG. 6) that drives the pinion 59. In this way, the printer unit 3 of a so-called station supply type that supplies ink from an ink cartridge to the discharge head 16 is configured. In this case, it is not necessary to connect the ink tube 60 to the carriage 17 at all times. As a result, it is possible to reduce the overall size of the printer unit 3.

Figure 5:
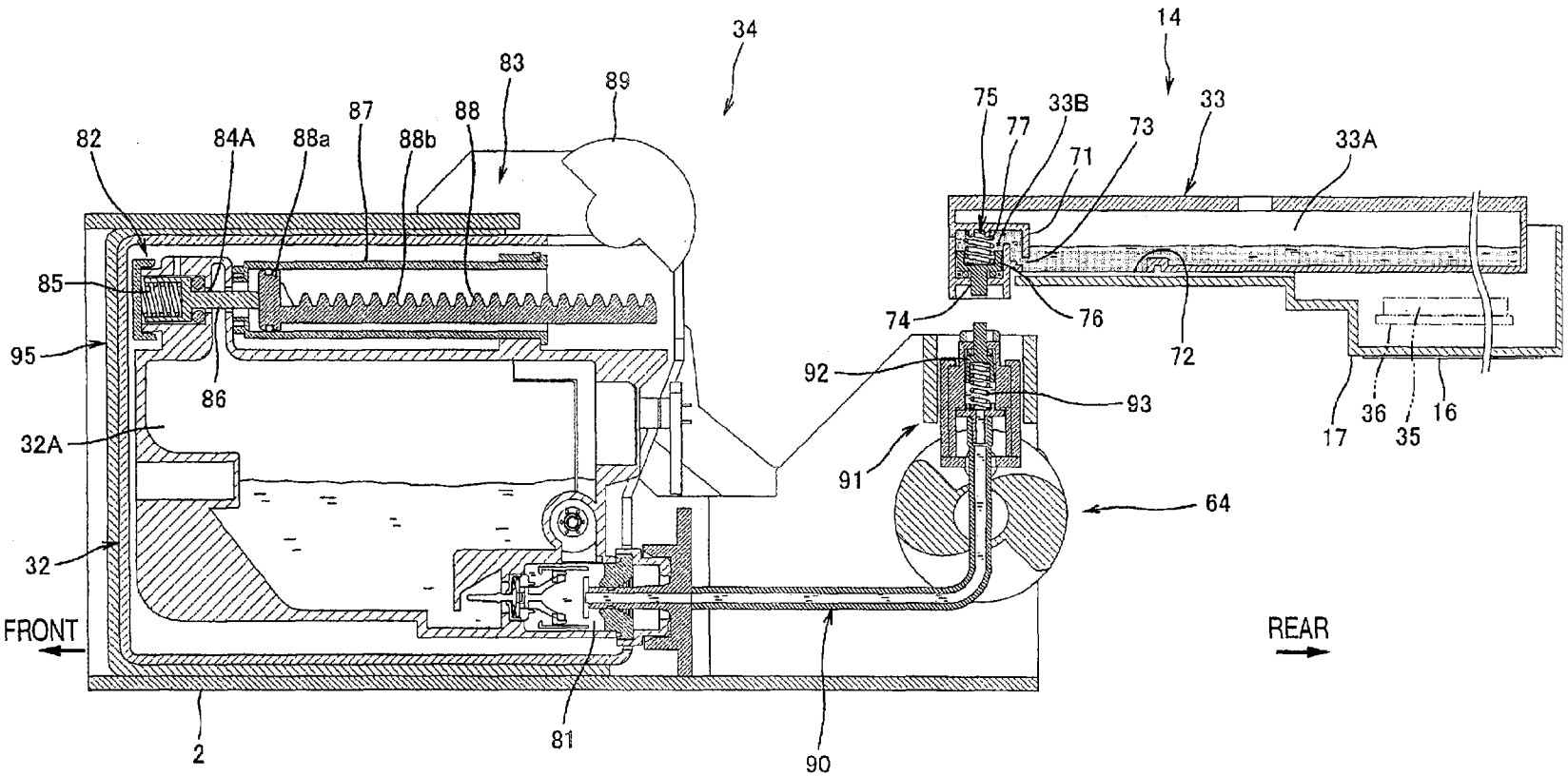
FIG. 5 is a cross-sectional view illustrating a structure of the image recording unit and a coolant replacement portion according to the first exemplary embodiment.

FIG. 5 is a cross-sectional view illustrating the structure of the image recording unit 14 and the coolant replacement portion 34 when the carriage 17 is disposed at the ink refill position. As shown in FIG. 5, the sub coolant tank 33 has a square shape that is elongated backward. As described above, the wiring substrate 36 having the IC chip 35 mounted thereon is provided inside the carriage 17, and the sub coolant tank 33 is arranged immediately above the IC chip 35 so as to extend backward (see FIG. 3).

A partition plate 71 that partitions the inside of the sub coolant tank 33 into a sub ink chamber 33A and a refill chamber 33B is provided in a front portion of the sub coolant tank 33. A communicating hole 73 that allows the two chambers 33A and 33B to communicate with each other is formed by a gap between an end portion of the partition plate 71 and the bottom 72 of the sub coolant chamber 33A. A refill port 74 that communicates with the outside is formed at a lower part of the refill chamber 33B. The refill chamber 33B has therein a refill port valve 75 that allows the sub coolant chamber 33A to communicate with a main coolant chamber 32A of the main coolant tank 32 during the replacement of a coolant. The refill port valve 75 includes a valve body 76 and a coil spring 77 having the same structure as those of the refill port valve 46. When no external force is applied to the valve body 76, the refill port 74 is closed. When external force is applied to the valve body 76 to move the valve body 76 against the urging force of the coil spring 77, the refill port 74 is opened such that the sub coolant chamber 33A communicates with the outside.

The main coolant tank 32 has the main coolant chamber 32A therein, and a coolant supply port 81 that allows the main coolant chamber 32A to communicate with the outside is provided in the bottom and the rear surface of the main coolant tank 32. In addition, a relief valve 82 and a pump 83 (coolant pump unit) are provided at an upper part of the main coolant chamber 32A. The relief valve 82 includes a valve body 84 and a coil spring 85 having the same structure as those of the relief valve 52 of the ink refill portion 31. The pump 83 includes a cylinder 87, a piston 88 having a piston crown 88*a* and a lock gear 88*b*, and a pinion 89, which are have the same structure as those of the pump 53 of the ink refill portion 31. When the pinion 89 is rotated, the pinion 88 reciprocates in the cylinder 87 to change the volume of the main coolant chamber 32A. When the piston 88 is moved forward, the piston crown 88*a* moves a pushrod 86 having the same structure as the pushrod 56 of the ink refill portion 31 to press the valve body 84 of the relief valve 82 forward, thereby opening the relief valve 82.

The coolant supply port 81 is connected to a joint valve 91 through a coolant tube 90 (coolant path) that is provided outside the main coolant tank 32. The joint valve 91 includes a valve body 92 and a coil spring 93, which have the same structure as those of the joint valve 61 of the ink refill portion 31. When no external force is applied to the valve body 92, the joint valve 91 is closed. When external force is applied to the valve body 92 to move the valve body 92 against the urging force of the coil spring 93, the main coolant chamber 32A communicates with the outside through the coolant tube 90 and the joint valve 91.

As shown in FIG. 3, the joint valve 91 and four joint valves 61 of the ink refill portion 31 are moved in the up-down direction by a single lift mechanism 64. Therefore, when the image recording unit 14 is at the ink refill position, the lift mechanism 64 is operated in response to the refill of ink to lift up the joint valve 91 such that the valve body 92 of the joint valve 91 and the valve body 76 of the refill port valve 75 are pressed against each other. In this way, the valves 75 and 91 are both opened. As a result, the main coolant chamber 32A of the main coolant tank 32 communicates with the sub coolant chamber 33A of the sub coolant tank 33.

In the first exemplary embodiment, among the above-mentioned components, the coolant replacement portion 34 includes the main coolant tank 32 having the main coolant chamber 32A and the pump 83, the coolant tube 90, the joint valve 91, the lift mechanism 64, and a pinion driving circuit 99 (see FIG. 6) that drives the pinion 89.

Further, a heat sink 95 that is made of a material having high thermal conductivity, such as aluminum, is provided in the periphery of the main coolant tank 32 so as to contact the main coolant tank 32. Therefore, the coolant in the main coolant tank 32 is cooled down by the radiation of heat from the heat sink 95, and the main coolant tank 32 serves as a radiator. As such, the coolant replacement portion 34 does not require a dedicated structure for cooling down the coolant. As a result, it is possible to simplify the structure of the coolant replacement portion.

Figure 6:
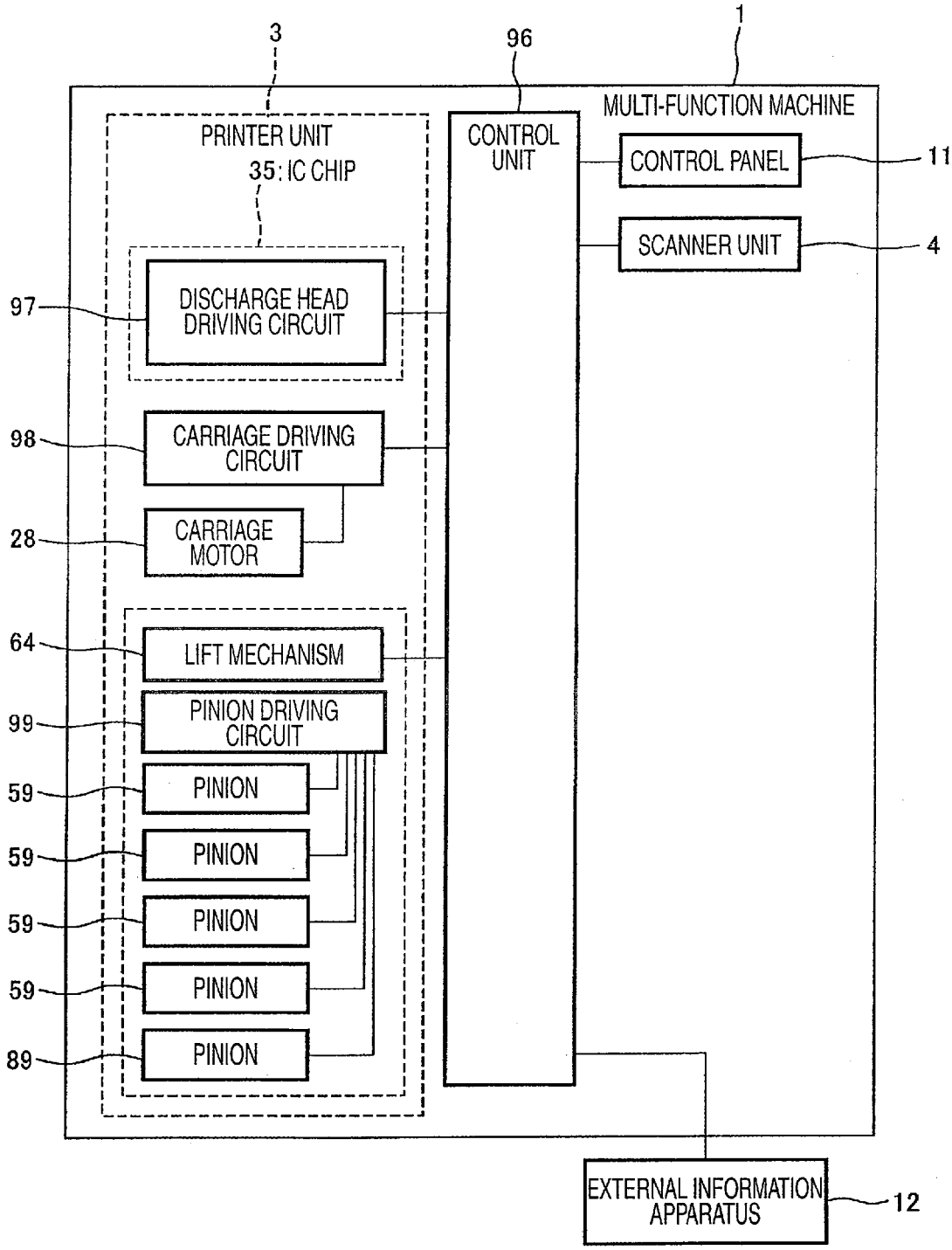
FIG. 6 is a block diagram illustrating a structure of a control unit according to the first exemplary embodiment.

FIG. 6 is a block diagram illustrating the structure of a control unit 96 (e.g., a carriage movement control unit, a liquid refill control unit, and a coolant replacement control unit) of the multi-function machine 1. The control unit 96 can control the overall operation of the printer unit 3. For example, the control unit 96 controls the movement of the carriage 17, the discharging of ink, the operations of the ink refill portion 31 and the coolant replacement portion 34, the transport of a recording sheet, and the operation of the maintenance mechanism 29.

As shown in FIG. 6, the control unit 96 includes a central processing unit (CPU), a random access memory (RAM), a read only memory (ROM), and an input/output interface. The control unit 96 is connected to the control panel 11 and receives instructions therefrom. The control unit 96 is connected to the external information apparatus 12 or the scanner unit 4 and receives image data therefrom. In addition, the control unit 96 is connected to the discharge head driving circuit 97, the carriage driving circuit 98, the lift mechanism 64, and the pinion driving circuit 99.

The discharge head driving circuit 97 controls the discharge head 16 to discharge ink onto the recording sheet on the basis of the discharge timing and the amount of ink determined by signals received from the control unit 96. In addition, the control unit 96 measures the ink level of the sub ink tank 15, on the basis of an instruction signal output from the discharge head driving circuit 97. That is, the control unit 96 calculates the cumulative vale of the discharge amount of each color ink (i.e., the total amount of ink discharged), and subtracts the cumulative value from a value indicating the full ink level of the sub ink tank 15 to individually calculate the ink level of each color ink in the sub ink tank 15. The carriage driving circuit 98 is connected to a carriage motor 28, and the carriage motor 28 is rotated to move the carriage 17. The lift mechanism 64 is operated on the basis of the signal from the control unit 96 to lift up the joint valves 61 and 91. The pinion driving circuit 99 drives a motor (not shown). When the motor is driven, the pinions 59 and 89 connected to an output shaft of the motor are rotated to operate the pumps 53 and 83, thereby changing the volumes of the main ink chamber 10A and the main coolant chamber 32A.

Figure 7:
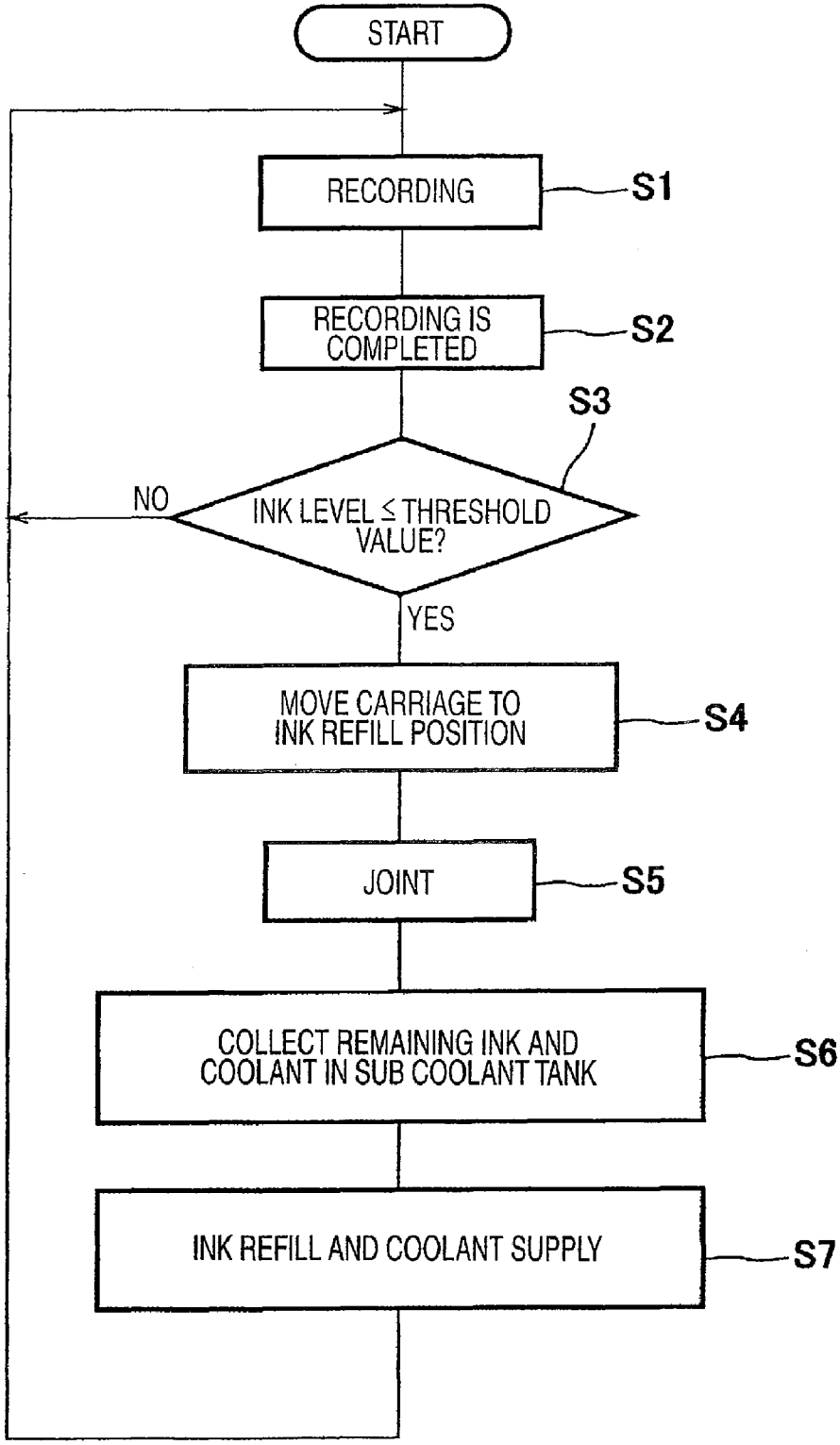
FIG. 7 is a flowchart illustrating an operation of the printer unit related to an ink refill process and a coolant replacement process according to the first and second exemplary embodiments.
Figure 8A:
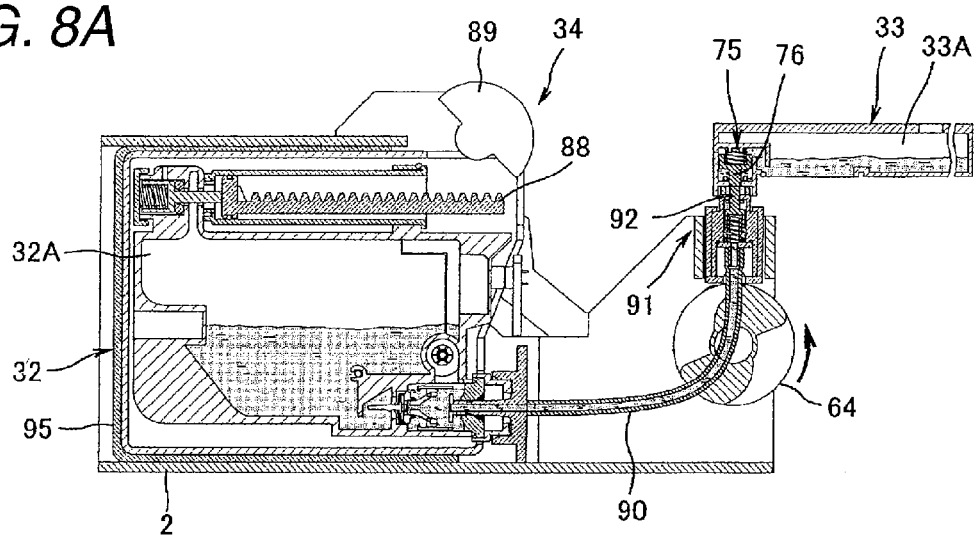
FIG. 8A shows a state in which a main coolant tank communicates with a sub coolant tank before ink refill.
Figure 8B:
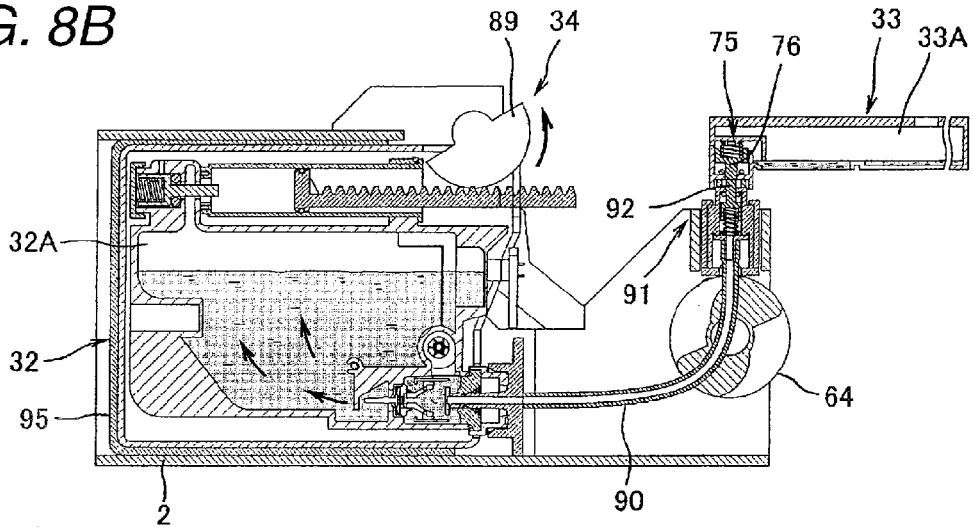
FIG. 8B shows a state in which a coolant is collected from the sub coolant tank.
Figure 8C:
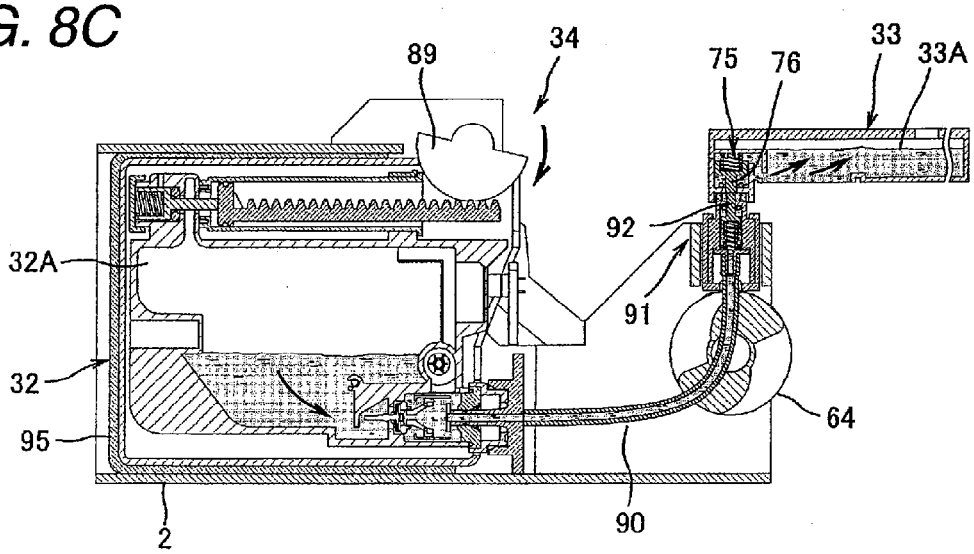
FIG. 8C shows a state in which ink is supplied to the sub coolant tank.

FIG. 7 is a flowchart illustrating the operation of the multi-function machine 1 (the printer unit 3) related to an ink refill process and a coolant replacement process that are performed by the control unit 96. FIG. 8 is a diagram schematically illustrating a variation in the states of the image recording unit 14 and the coolant replacement unit 34 during a coolant replacement process. Specifically, FIG. 8A shows the state in which the main coolant tank 32 communicates with the sub coolant tank 33 before the coolant replacement process, FIG. 8B shows the state in which the coolant is collected from the sub coolant tank 33, and FIG. 8C shows the state in which ink is supplied to the sub coolant tank 33. FIG. 5 shows the state in which the main coolant tank 32 does not communicate with the sub coolant tank 33 before the coolant replacement process.

As shown in FIG. 7, the multi-function machine 1 using the printer unit 3 records an image onto a recording sheet by a combination of a control process of transporting the recording sheet, a control process of reciprocating the carriage 17 in the right-left direction at the ink discharge position, and an ink discharge control process (Operation S1). When the recording of an image is completed (Operation S2), the multi-function machine 1 determines whether the ink level of the sub ink tank 15 is lower than a threshold value on the basis of the measured result of the ink level (Operation S3). The determination may be performed by software. As can be seen from the positional relationship shown in FIG. 3, when the carriage 17 is disposed at the ink discharge position, the ink cartridge 10 does not communicate with the sub ink tank 15, and the main coolant tank 32 does not communicate with the sub coolant tank 33. During an image recording process, the ink discharge control causes heat to be generated from the internal resistance of the discharge head driving circuit 97, but the heat generated from the IC chip 35 is absorbed by the coolant stored in the sub coolant tank 33 that is provided immediately above the IC chip 35. Therefore, it is possible to prevent an increase in the surrounding temperature of the discharge head 16.

if it is determined that the value indicating the ink level is larger than the threshold value, the multi-function machine returns to Operation S1 to record an image on the next recording sheet. On the other hand, if it is determined that the value indicating the ink level is less than or equal to the threshold value, the multi-function machine drives the carriage motor 28 (see FIG. 3) to move the carriage 17 to the ink refill position (Operation S4). In this case, the positional relationship shown in FIG. 4 is established between the ink cartridge 10 and the sub ink tank 15, and the positional relationship shown in FIG. 5 is established between the main coolant tank 32 and the sub coolant tank 32.

Then, the ink refill portion 31 is operated to join the ink cartridge 10 with the sub ink tank 15, and the coolant replacement portion 34 is operated to join the main coolant tank 32 and the sub coolant tank 33 (Operation S5). That is, the lift mechanism 64 is operated to lift up the joint valves 61 and 91 such that the sub ink chamber 15A communicates with the main ink chamber 10A through the joint valve 61 and the refill port valve 47, and the sub coolant chamber 33A communicates with the main coolant chamber 32A through the joint valve 91 and the refill port valve 75, as shown in FIG. 8A.

When the ink chambers 10A and 15A communicate with each other and the coolant chambers 32A and 33A communicate with each other, the pinions 59 and 89 are rotated to move the pistons 58 and 88 backward, respectively, thereby making the inside of the main ink chamber 10A and the inside of the main coolant chamber 32A at a negative pressure. In this way, the ink remaining in the sub-ink chamber 15A is collected into the main ink chamber 10A once, and the coolant whose temperature is increased due to heat exchange with the IC chip 35 in the sub coolant chamber 33A is collected to the main coolant chamber 32A once, as shown in FIG. 8B (Operation S6).

After the collecting process is completed, the pinions 59 and 89 are reversely rotated to move the pistons 58 and 88 forward, respectively, thereby making the inside of the main ink chamber 10A and the inside of the main coolant chamber 32A at a positive pressure. In this way, ink is supplied from the main ink chamber 10A to the sub ink chamber 15A, and coolant is supplied from the main coolant chamber 32A to the sub coolant chamber 33A, as shown in FIG. 8C (Operation S7). The coolant in the main coolant tank 32 is cooled down by the radiation of heat from the heat sink 95, while the carriage 17 is disposed at the ink discharge position. In Operation S7, even though the coolant whose temperature is increased is mixed with the coolant present in the main coolant tank 32, the coolant is cooled down in this way and then supplied from the main coolant tank 32 to the sub coolant tank 33. When the ink refill process and the ink replacement process are completed, the multi-function machine returns to Operation S1 to resume the recording of an image on the next recording sheet.

As such, in the printer unit 3 of a so-called station supply type, when the carriage 17 is disposed at the ink discharge position, a path for circulating ink between the main coolant tank 32 of the housing 2 and the sub coolant tank 33 of the carriage 17 is closed. However, when the carriage 17 is disposed at the ink refill position, the path is opened. Therefore, it is not necessary to ensure a space for the path for circulating a coolant. As a result, it is possible to achieve a structure for water-cooling the carriage 17 while reducing the overall size of a device.

In the first exemplary embodiment, the ink refill process is performed in such a manner that the ink remaining in the sub ink chamber 15A is collected. When ink is supplied from the main ink chamber 10A, the empty space of the sub ink chamber 15A is uniformly filled. Therefore, it is possible to accurately refill the sub ink chamber 15A with ink up to a maximum level, without providing a sensor for detecting the ink level in the sub ink tank 15. In addition, in Operation S6, when the ink remaining in the sub ink chamber 15A is collected to the main ink chamber 10A, an amount of ink remains in the ink remaining portion 50 of the sub ink tank 15. Therefore, it is possible to prevent the drying of ink in the vicinity of the second communicating hole 42, and air infiltration from the second communicating hole 42 to the discharge head 16.

Additionally, in the first exemplary embodiment, a same method as that in the ink refill process is applied to the coolant replacement process. The coolant in the sub coolant chamber 33A is collected and then a coolant is supplied from the main coolant tank 32 to the sub coolant tank. Since the operation for ink refill is the same as that for coolant replacement, it is possible to use a single device, such as the lift mechanism 64, for the two operations. As a result, it is possible to simplify the structures of the ink refill portion 31 and the coolant replacement portion 34. In addition, since parts, such as the joint valves 61 and 91 and the pumps 53 and 83, are commonly used, it is possible to reduce the manufacturing costs of the coolant replacement portion 34. Since a coolant is supplied after the coolant is collected, it is possible to use one path (the coolant tube 90) to circulate the coolant between the main coolant tank 32 and the sub coolant tank 33. As a result, it is possible to simplify the structure of the coolant replacement portion 34.

Second Exemplary Embodiment

Next, a printer unit 103 according to a second exemplary embodiment of the invention that can be mounted to the multi-function machine 1 shown in FIG. 1 will be described.

In the second exemplary embodiment, the same components as those in the printer unit 3 according to the first exemplary embodiment are denoted by the same reference numerals, and a description thereof will be omitted for clarity of description.

Figure 9:
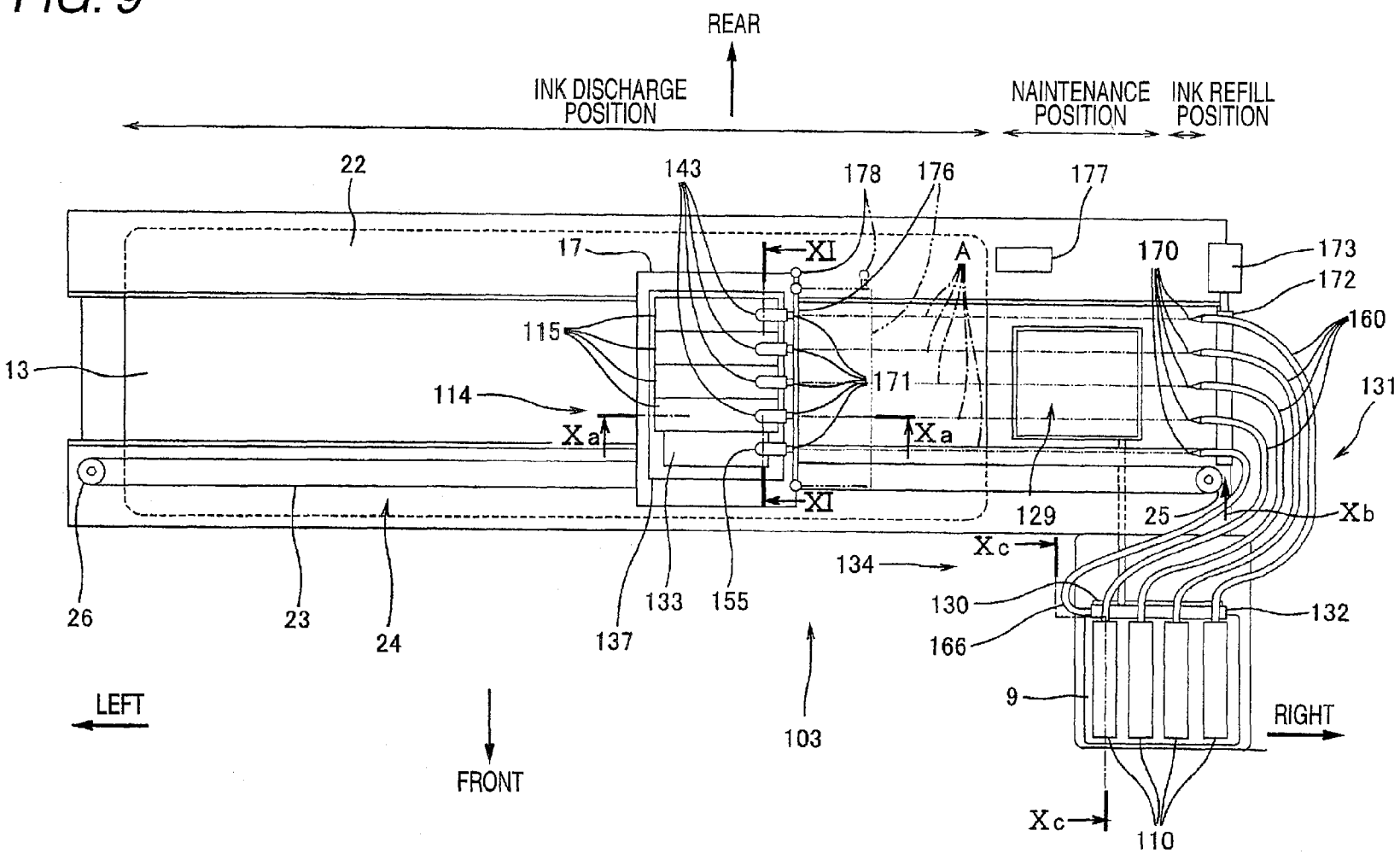
FIG. 9 is a plan view schematically illustrating a structure of a printer unit according to a second exemplary embodiment.

FIG. 9 is a plan view schematically illustrating the structure of the printer unit 103. As shown in FIG. 9, a maintenance mechanism 129 and a liquid waste foam 130 are provided on the right side of the platen 13 so as to be adjacent to the cartridge mounting portion 9. Four ink cartridges 110 are mounted to the cartridge mounting portion 9 so as to be arranged in the right-left direction, and a main coolant tank 132 having a substantially square shape is provided in front of the four ink cartridges 110 so as to extend above the liquid waste foam 130 in the right-left direction. As a result, in the scanning range of a carriage 17 of an image recording unit 114, a maintenance position is set on the right side of an ink discharge position, and an ink refill position is set at the right limit of the scanning range. A head holder 137 having a substantially rectangular box shape is provided in the carriage 17, and four sub ink tanks 115 corresponding to four color inks and a sub coolant tank 133 are attached to the head holder 137. The four sub ink tanks 115 are arranged in the front-back direction.

Figure 10:
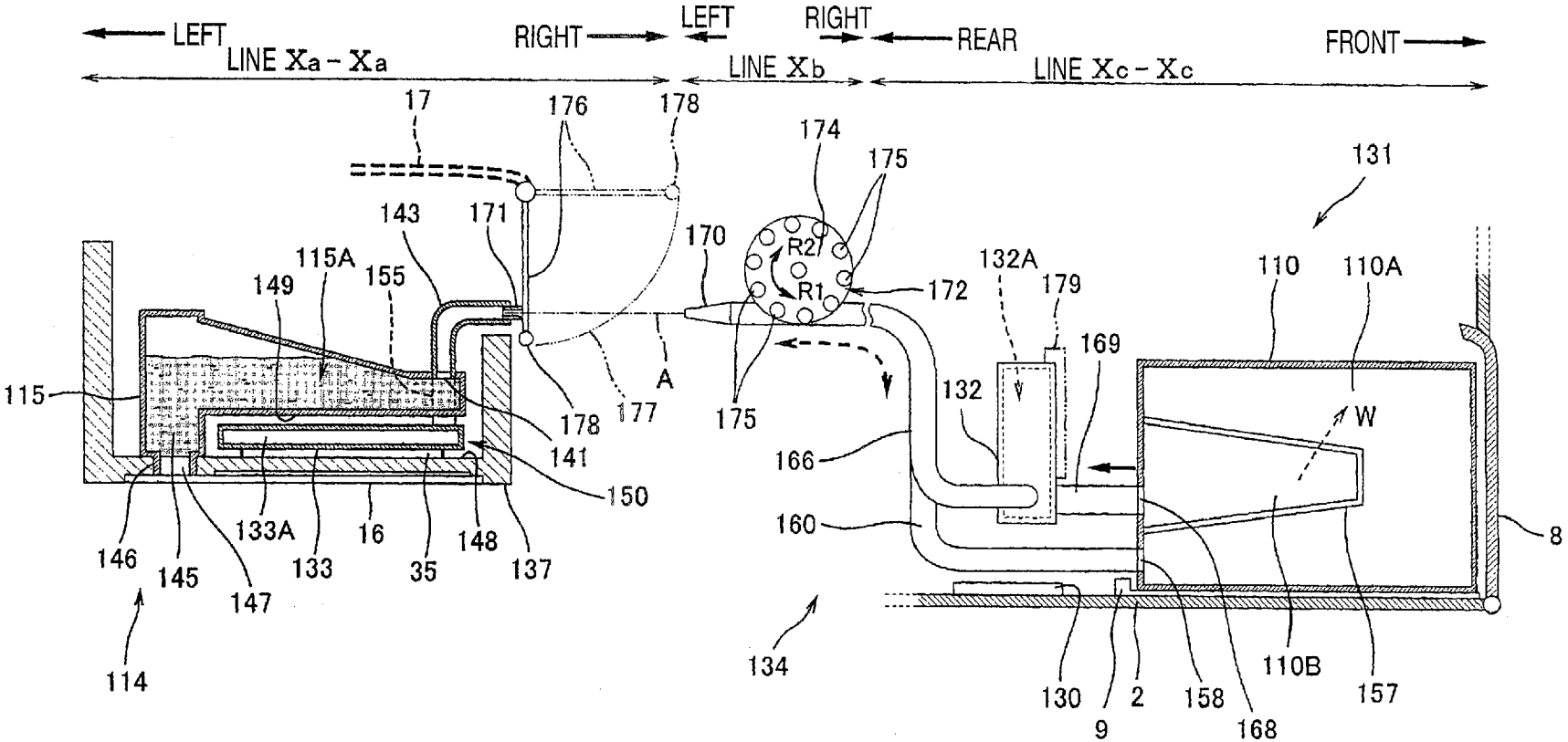
FIG. 10 is a cross-sectional view illustrating structures of an image recording unit, an ink refill portion, and a coolant replacement portion according to the second exemplary embodiment taken along the lines Xa-Xa, Xb, and Xc-Xc of FIG. 9.
Figure 11:
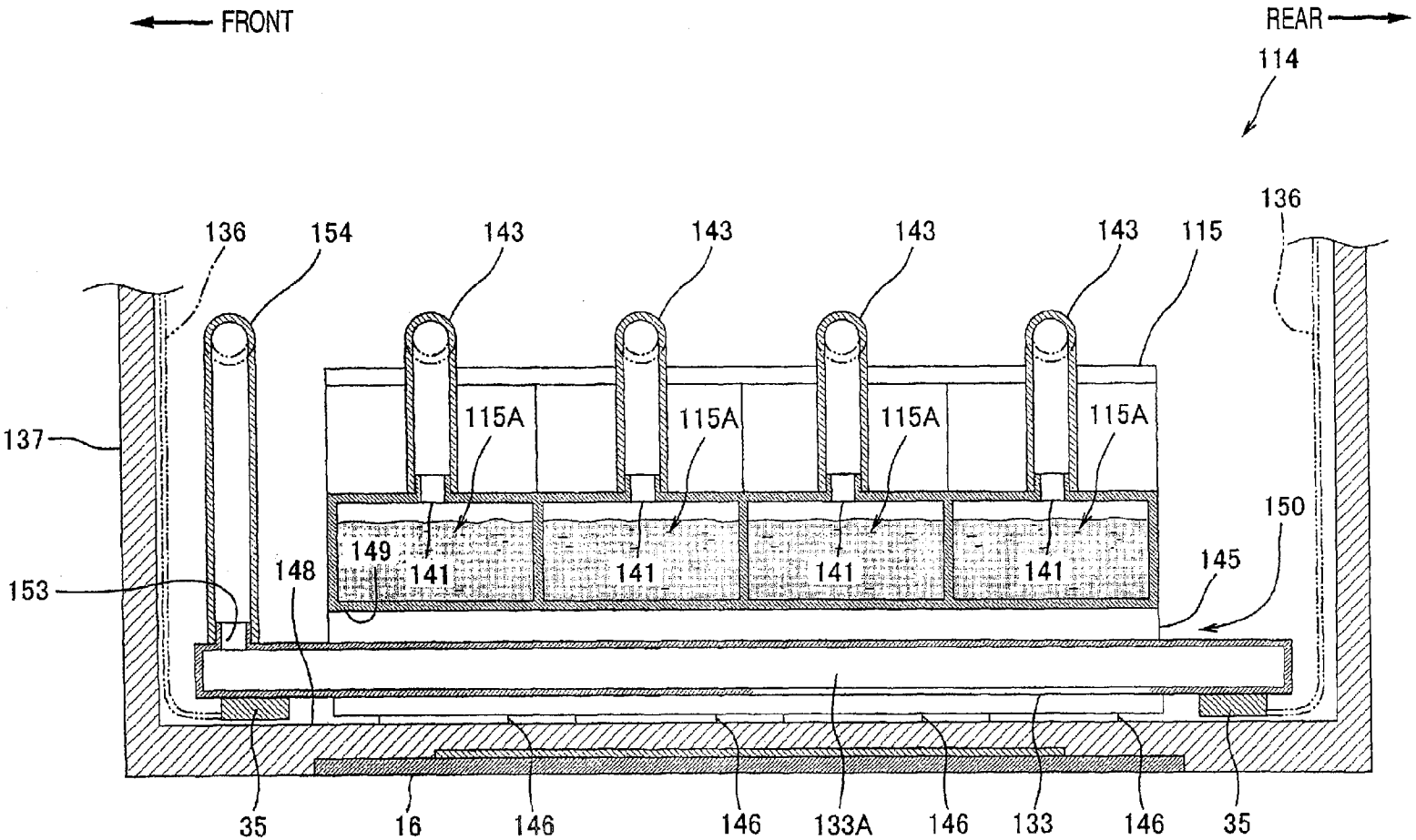
FIG. 11 is a cross-sectional view illustrating the structure of the image recording unit according to the second exemplary embodiment taken along the line XI-XI of FIG. 9.

FIG. 10 is a cross-sectional view taken along the lines Xa-Xa, Xb, and Xc-Xc of FIG. 9, and shows the structures of the image recording unit 114, an ink refill portion 131, and a coolant replacement portion 134. FIG. 11 is a cross-sectional view taken along the line XI-XI of FIG. 9, and shows the structure of the image recording unit 114.

As shown in FIG. 10, a sub ink chamber 115A having a substantially triangular shape that is elongated in the right-left direction in a plan view is provided in the sub ink tank 115. The bottom of the sub ink chamber 115A extends in the horizontal direction, and the upper surface thereof is formed so as to be inclined upward toward the left side. A sub communicating hole 141 that allows the sub ink chamber 115A to communicate with the outside is provided in the upper surface of the sub ink tank 115. A sub ink tube 143 that extends in the right-left direction outside the sub ink tank 115 is connected to the sub ink communicating hole 141.

An ink remaining portion 145 communicating with the sub ink chamber 115A is provided at the rear end of the sub ink tank 115 so as to protrude downward. A protruding portion 146 having a cylindrical shape is formed on the lower surface of the ink remaining portion 145 so as to protrude downward. The protruding portion 146 is inserted so as to pass through the bottom wall of the head holder 137 in the up-down direction. Therefore, the sub-ink chamber 115A communicates with an upstream-side opening of an ink passage of the discharge head 16 that is attached to the outer bottom of the head holder 137 through the ink remaining portion 145 and a communicating hole 147 formed by the inner surface of the protruding portion 146.

As shown in FIGS. 10 and 11, inside the head holder 137, a space 150 having a volume corresponding to the height (depth) of the ink remaining portion 145 is formed between an inner bottom 148 of the head holder 137 and a lower surface 149 of the sub ink tank 115. Two IC chips 35 mounted to a wiring substrate 136, which is provided on the inner bottom 148 of the head holder 137, is accommodated in the space 150. The two IC chips 35 are arranged in the space 150 so as to be separated from each other in the front-back direction. In addition, the sub coolant tank 133 is accommodated in the space 150 so as to be provided on the upper surfaces of the two IC chips 35. In this way, the sub coolant tank 133 is effectively arranged in the space formed by the ink remaining portion 145. Therefore, it is possible to reduce the overall size of a carriage.

The sub coolant tank 133 has a sub coolant chamber 133A therein, and a sub coolant supply port 153 that allows the sub coolant chamber 133A to communicate with the outside is provided in the rear surface of the sub coolant tank 133. A rear portion of the sub coolant tank 133 protrudes backward from the space 150, and the sub coolant supply port 153 is connected to a sub coolant tube 154 that extends upward from the protruding portion and also extends in the right-left direction with the same height as that of the sub ink supply tube 143.

As shown in FIG. 10, a main ink chamber 110A (liquid reservoir) that stores ink and a coolant refill chamber 110B (coolant reservoir) that can store a coolant are formed inside the ink cartridge 110. These two chambers 110A and 110B are divided by a partition wall 157. A main ink supply port 158 that allows the main ink chamber 110A to communicate with the outside is provided in the bottom and the rear surface of the ink cartridge 110, and a main ink tube 160 is connected to the main ink supply port 158. The main ink tube 160 extends backward and is curved on the right side. Then, the main ink tube 160 extends backward to pass the right side of the guide rail 23 (see FIG. 9), and is then curved on the left side to be disposed between the right ends of the two guide rails 22 and 23 in the front-back direction.

A main coolant chamber 132A is formed in the main coolant tank 132. A main coolant supply port 163 that allows the main coolant chamber 132A to communicate with the outside is provided in the bottom and the left surface of the main coolant tank 132, and a main coolant tube 166 is connected to the main coolant supply port 163. The main coolant tube 166 extends backward and is then curved on the right side. Then, the main coolant tube 166 extends backward to pass the right side of the guide rail 23 (see FIG. 9), and is then curved on the left side to be disposed between the right ends of the two guide rails 22 and 23 in the front-back direction.

A refill coolant outlet 168 that allows the coolant refill chamber 110B to communicate with the outside is formed in the front surface of the ink cartridge 110, and a coolant refill tube 169 that communicates with the main coolant chamber 132A of the main coolant tank 132 is connected to the refill coolant outlet 168.

As shown in FIGS. 9 and 11, the sub ink tubes 143 and the sub coolant tube 154 are provided substantially at an equal interval in the front-back direction. As shown in FIGS. 9 and 10, the open ends of the main ink tube 160 and the main coolant tube 166 are also arranged substantially at an equal interval in the front-back direction. As represented by a one-dot chain line A, the end of the main tube and the end of the sub tube are arranged so as to be opposite to each other in the right-left direction, which is the scanning direction of the carriage 17.

Tapered needle portions 170 having a conical shape are provided at the open ends of the main tubes 160 and 166. Ring-shaped seals 171 that are formed of an elastic material, such as rubber, are inserted into the ends of the sub tubes 143 and 155, and the seals 171 partially protrude from the ends of the tubes 143 and 155.

A tube pump 172 is provided between the right ends of the two guide rails 22 and 23. The tube pump 172 includes a cylindrical drum portion 174 that is rotated by a pump motor 173 supported by the guide rail 22 and indenters 175 that are provided on the outer circumferential surface of the drum portion 174, and is arranged above the main tubes 160 and 166.

When the drum portion 174 is rotated, the indenters 175 are rotated while pressing the main tubes 160 and 166. Then, the internal pressure of each of the tubes varies, which causes the ink or the coolant in the tube to be transported.

As shown in FIG. 9, a cover 176 is attached to the right side of the carriage 17 of the image recording unit 114. The cover 176 can swing about a shaft, which is provided in an upper right portion of the carriage 17 so as extend in the front-back direction, from a closed position where the cover is vertical to the swing shaft in the downward direction, which is represented by a solid line, and an opened position where the cover is parallel to the swing shaft, which is represented by a two-dot chain line. As shown in FIG. 10, when the cover 176 is disposed at the closed position, the right end surface of the carriage 17 is covered with the cover 176. The seals 171 provided at the ends of the sub tubes 143 and 155 are closely adhered to the left surface of the cover 176, and the sub tubes 143 and 155 are closed. In this way, the ink in the sub ink tank 115 and the coolant in the sub coolant tank 133 are prevented from evaporating. On the other hand, when the cover 176 is disposed at the opened position, the ends of the sub tubes 143 and 155 are opened, and the ends of the tubes 143 and 155 are exposed from the right side.

When the carriage 17 is at an ink discharge position or a maintenance position, the cover 176 is moved to the closed position by its own weight. The printer unit 103 is provided with an opening mechanism that moves the cover 176 from the closed position to the opened position when the carriage 17 is at an ink refill position. For example, as shown in FIGS. 9 and 10, the opening mechanism includes a cam plate 177 that is provided on the guide rail 22 and a cam follower 178 that is attached to an end of the cover 176 that is opposed to the swing shaft. The cam follower 178 has, for example, a spherical shape and can slide on the cam surface of the cam plate 177. As shown in FIG. 10, the cam surface of the cam plate 177 is formed to correspond to the swing locus of the end of the cover 176. Specifically, the cam surface has an arc shape having the swing shaft as its center in a front view and is formed so as to be inclined upward toward the right side that is close to the ink refill position (the cam plate 177 shown in FIG. 10 is represented by a virtual line for clarity of the description of the opening mechanism, but FIG. 10 does not show the positional relationship between the cam plate and the image recording unit 114). Therefore, when the cam follower 178 comes into contact with the cam surface of the cam plate 177 while the carriage 17 is moved from the left side to the ink refill position, the cam follower slides on the cam surface to move upward, and the cover 178 connecting the cam follower 178 swings from the closed position to the opened position. As described above, the swing of the cover 176 is mechanically performed with the movement of the carriage 17.

In the second exemplary embodiment, among the above-mentioned components, the ink refill portion 131 includes the ink cartridge 110 having the main ink chamber 110A, the main and sub ink tubes 160 and 143, the tube pump 172, and a tube pump driving circuit 199 (see FIG. 12) that drives the tube pump 172. In addition, among the above-mentioned components, the coolant replacement portion 134 includes the main coolant tank 132 having the main coolant chamber 132A, the main and sub coolant tubes 166 and 155, the ink cartridge 110 having the coolant refill chamber 110B, the coolant refill tube 169, the tube pump 172, and the tube pump driving circuit 199.

In the second exemplary embodiment, aqueous ink is used. The coolant includes water, which is a solvent of the aqueous ink, as a main ingredient; a preservative, glycerin; and fine capsules having a phase-change material encapsulated therein. The concentration of the coolant is lower than the molar concentration of the aqueous ink, and the partition wall 157 between the coolant refill chamber 110B and the main ink chamber 110A shown in FIG. 10 is formed of a material having water permeability. Therefore, in the ink cartridge 110, as represented by a dashed arrow W in FIG. 10, water, which is the solvent of the coolant stored in the coolant refill chamber 110B can be infiltrated into the main ink chamber 110A through the partition wall 157 due to osmotic pressure generated by a difference in concentration between the water and the coolant.

Since the material, length, and diameter of the main ink tube 160 are known, it is possible to estimate the amount of ink evaporated from the tube 160 to the outside per unit time. Therefore, even when ink evaporation occurs, it is possible to maintain the concentration of ink at a constant level for a long time by making the amount of water passing (infiltrated) from the coolant refill chamber 110B to the main ink chamber 110A per unit time equal to the estimated evaporation amount of ink in consideration of the material, surface area, and thickness of the partition wall 174. As a result, it is possible to maintain the viscosity of ink at a constant level for a long time.

Figure 12:
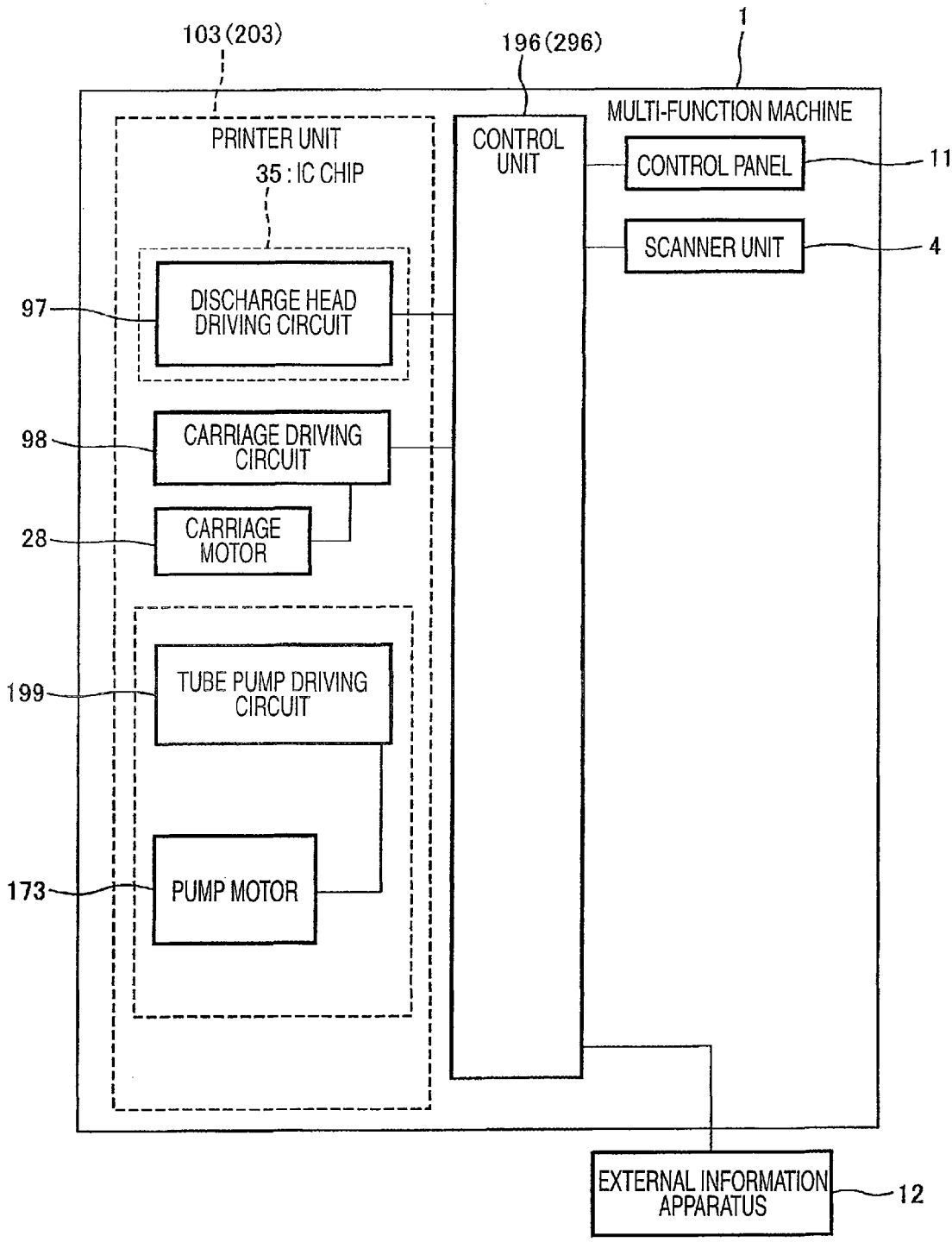
FIG. 12 is a block diagram illustrating a structure of a control unit according to the second and third exemplary embodiments.

FIG. 12 is a block diagram illustrating the structure of a control unit 196 of the multi-function machine 1 provided with the printer unit 103. The control unit 196 is connected to the scanner unit 4, the control panel 11, the external communication apparatus 12, the discharge head driving circuit 97 that is provided in the IC chip 35, the carriage driving circuit 98, and the pump driving circuit 199. The pump driving circuit 199 drives the pump motor 173 to rotate the drum portion 174 of the tube pump 172 that is connected to an output shaft of the pump tube 173.

Figure 13:
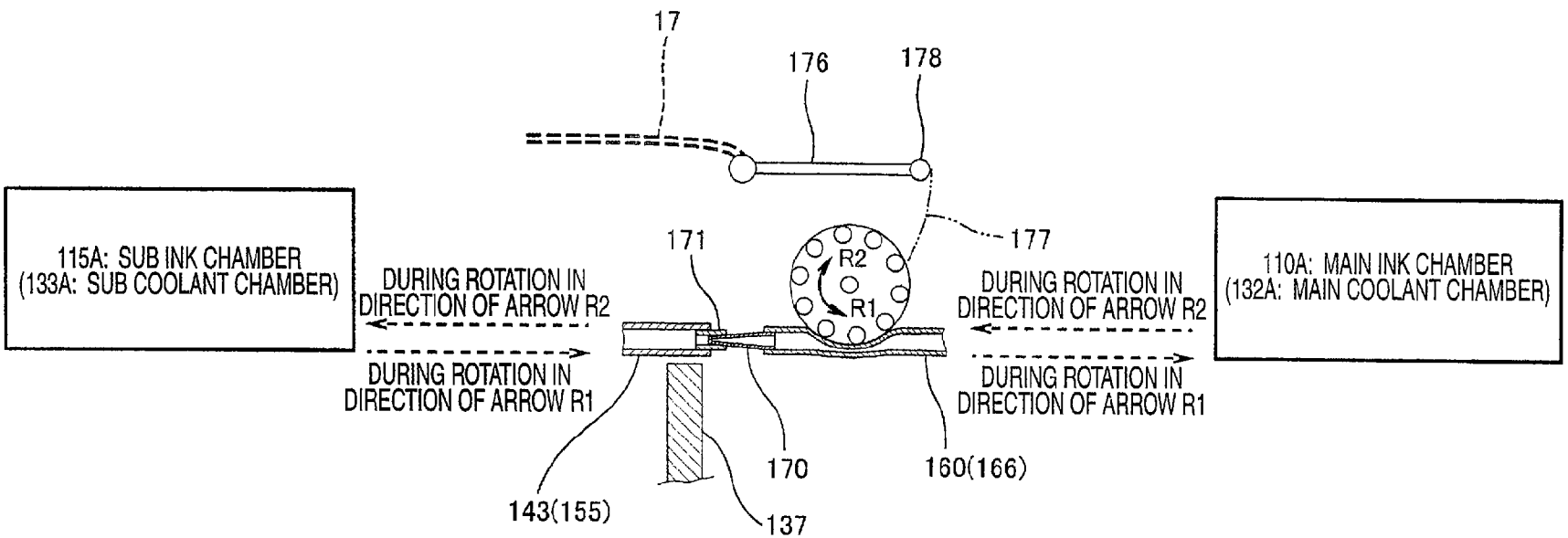
FIG. 13 is a cross-sectional view illustrating states of ends of tubes during a coolant replacement process according to the second exemplary embodiment.

The operation of the multi-function machine 1 (the printer unit 103) related to an ink refill process and a coolant replacement process that are performed by the control unit 196 is the same as that shown in FIG. 7. FIG. 13 is a cross-sectional view illustrating the states of the ends of the main and sub tubes when the carriage 17 is disposed at the ink refill position.

As shown in FIG. 7, the printer unit 103 records an image on a recording sheet (Operation S1). When the recording of an image on the recording sheet is completed (Operation S2), the printing unit 103 determines whether the ink level of the sub ink tank 115 is lower than a threshold value (Operation S3). In Operations S1 to S3, the carriage 17 is at the ink discharge position.

As can be seen from FIG. 9, when the carriage 17 is disposed at the ink discharge position, the ink cartridge 110 does not communicate with the sub ink tank 115, and the main coolant tank 132 does not communicate with the sub coolant tank 133. Since the cover 176 is disposed at the closed position, the sub tubes 143 and 155 are closed, and the main tubes 160 and 166 are pressed by the indenters 175 of the tube pump 172. Therefore, no ink or coolant leaks from the main and sub tubes to the inside of the housing 2. Heat generated from the IC chip 35 when an image is recorded is absorbed by the coolant stored in the sub coolant tank 133 that is provided immediately above the IC chip 35. Therefore, it is possible to prevent an increase in the surrounding temperature of the discharge head 16.

In Operation S3, if it is determined that the value indicating the ink level is larger than the threshold value, the printing unit returns to Operation S1 to record an image on the next recording sheet. On the other hand, if it is determined that the value indicating the ink level is less than or equal to the threshold value, the printing unit drives the carriage motor 28 (see FIG. 9) to move the carriage 17 to the ink refill position (Operation S4). While the carriage 17 is moved from the ink discharge position to the ink refill position, the cam follower 178 attached to the carriage 17 slides on the cam surface of the cam plate 177 attached to the guide rail 22. Then, the cover 176 swings to the upper right side, and the sub tubes 143 and 155 are opened to the right side. In this state, when the carriage 171 is moved up to the ink refill position, as shown in FIG. 13, the needle portions 170 attached to the ends of the main tubes 160 and 166 are inserted into the seals 171 of the corresponding sub tubes 143 and 155 so as to tightly mate with the inner circumferential surfaces of the seals 171. In this way, the main ink chamber 110A and the sub ink chamber 115A communicate with each other through the ink tubes 160 and 143, and the main coolant chamber 132A and the sub coolant chamber 133A communicate with each other through the coolant tubes 166 and 155 (Operation S5). Therefore, in the second exemplary embodiment, the ink refill portion 131 and the coolant replacement portion 134 are configured such that the main and sub sides automatically communicate with each other by moving the carriage 17 to the ink refill position.

When the two ink chambers 110A and 115A communicate with each other and the two coolant chambers 132A and 133A communicate with each other, the tube pump 172 is driven. In this case, first, as represented by an arrow R1 in FIG. 13, the drum portion 174 of the tube pump 172 is rotated in the counterclockwise direction in a front view. Then, the ink in the ink tubes 160 and 143 flows from the sub ink chamber 115A to the main ink chamber 110A, and the coolant in the coolant supply tubes 166 and 155 flows from the sub coolant chamber 133A to the main coolant chamber 132A. In this way, the ink in the sub ink chamber 115A is collected into the main ink chamber 110A, and the coolant whose temperature is increased in the sub coolant chamber 133A is collected into the main coolant chamber 132A (Operation S6).

As shown in FIGS. 9 and 10, the liquid waste foam 130 is arranged below the main coolant tank 132. Therefore, after the coolant whose temperature is increased in the sub coolant tank 133 is collected into the main coolant tank 132, the heat of the coolant in the main coolant tank 132 is consumed as the latent heat of evaporation of the ink absorbed by the liquid waste foam 130. Therefore, the coolant in the main coolant tank 132 is effectively cooled down, and the main coolant tank 132 functions as a radiator. In addition, since the evaporation of the ink absorbed by the liquid waste foam 130 is accelerated, it is possible to reduce the absorption capacity of the liquid waste foam 130. In addition, with the evaporation of the ink, the surrounding temperature of the ink cartridge 110 and the main coolant tank 132 is increased. Therefore, the evaporation of the ink and the coolant in the corresponding tubes is prevented. As represented by a two-dot chain line in FIG. 10, in order to improve the radiator function of the main coolant tank 132, a heat sink 179 that is made of a material having high heat capacity, such as aluminum, may be contacted with the main coolant tank 132.

Even when the coolant is evaporated, the tube pump 172 is driven to supply the coolant stored in the coolant refill chamber 110B to the main coolant chamber 132A through the coolant refill tube 169. In this way, the main coolant chamber 132A or the sub coolant chamber 133A are kept frill.

Then, as represented by an arrow R2 in FIG. 13, the drum portion 174 of the tube pump 172 is rotated in the clockwise direction in a front view. Then, the ink in the ink tubes 160 and 143 flows from the main ink chamber 110A to the sub ink chamber 115A, and the coolant in the coolant supply tubes 166 and 155 flows from the main coolant chamber 132A to the sub coolant chamber 133A. In this way, the ink in the main ink chamber 110A is supplied to the sub ink chamber 115A, and the coolant that is cooled down in the main coolant chamber 132A is supplied to the sub coolant chamber 133A (Operation S7). When the refill of ink and the replacement of the coolant are completed, the printing unit returns to Operation S1 to record an image on the next recording sheet.

In the printing unit 103 according to the second exemplary embodiment, when the carriage 17 is disposed at the ink discharge position, a path for circulating a coolant is closed, and when the carriage 17 is disposed at the ink refill position, the path is opened. Therefore, it is possible to achieve a structure for water-cooling the carriage 17 while reducing the overall size of a device.

In the first exemplary embodiment, the lift device 64 is provided as a dedicated device for closing or opening the path, and the lift device 64 is operated against the urging force of the coil springs of a total of ten valves since the coolant replacement portion 34 is added to the ink refill portion 31. Therefore, the load of the lift device 64 is likely to increase. However, in the printer unit 103 according to the second exemplary embodiment, a valve that is maintained in a closed state by the urging force is omitted, and the closing or opening of a path connecting the main side and the sub side is automatically performed by the mechanical insertion or removal of the needle portions 170 into or from the seals 171 with the movement of the carriage 17. As such, the driving force of the carriage motor 28, which is generally provided in a shuttle type printer, may be used to close or open the path between the main side and the sub side. Therefore, since the driving force of the carriage motor 28 for the opening or closing of the path is lower than that of the lift device 64, it is possible to reduce the sizes of the coolant replacement portion 134 and the ink refill portion 131. In addition, when the ink refill process or the coolant replacement process is not performed since the carriage 17 is separated from the ink refill position, the cover 176 that is swingably provided closes the open ends of the sub tubes, and the tube pump 172 is used to press the main tubes. Therefore, even in the structure without a valve, it is possible to prevent the leakage or evaporation of ink or a coolant, similar to the structure including a valve. Further, the seals 171 made of an elastic material partially protrude from the sub tubes. Therefore, it is possible to reliably maintain the sub tubes in a closed state by bring the cover 176 at the closed position into close contact with the seals 171.

Next, a printer unit 203 according to a third exemplary embodiment of the invention that can be mounted to the multi-function machine 1 shown in FIG. 1 will be described. In the third exemplary embodiment, the same components as those in the first and second exemplary embodiments are denoted by the same reference numerals, and a description thereof will be omitted for clarity of description.

Figure 14:
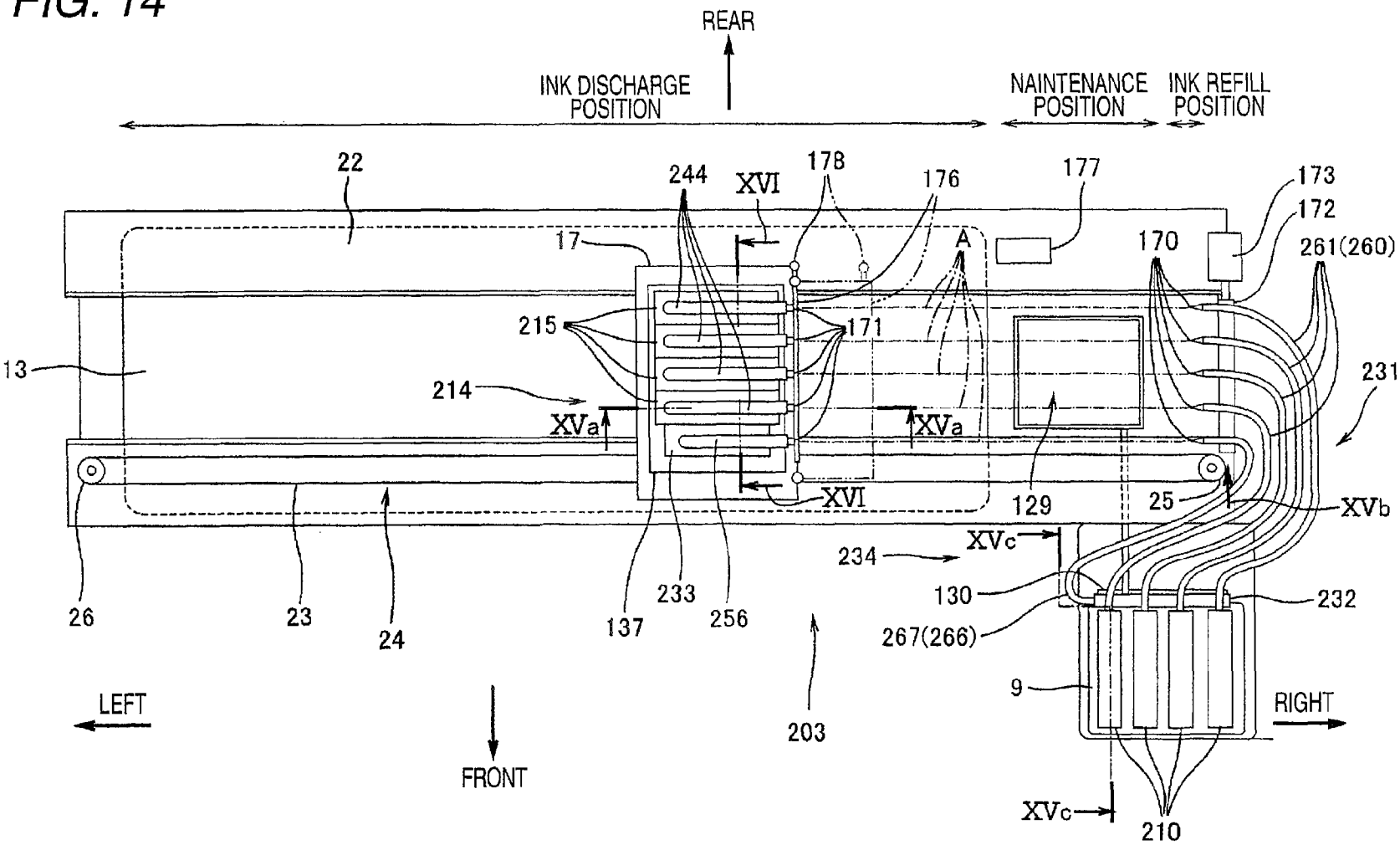
FIG. 14 is a plan view schematically illustrating a structure of a printer unit according to the third exemplary embodiment.
Figure 15:
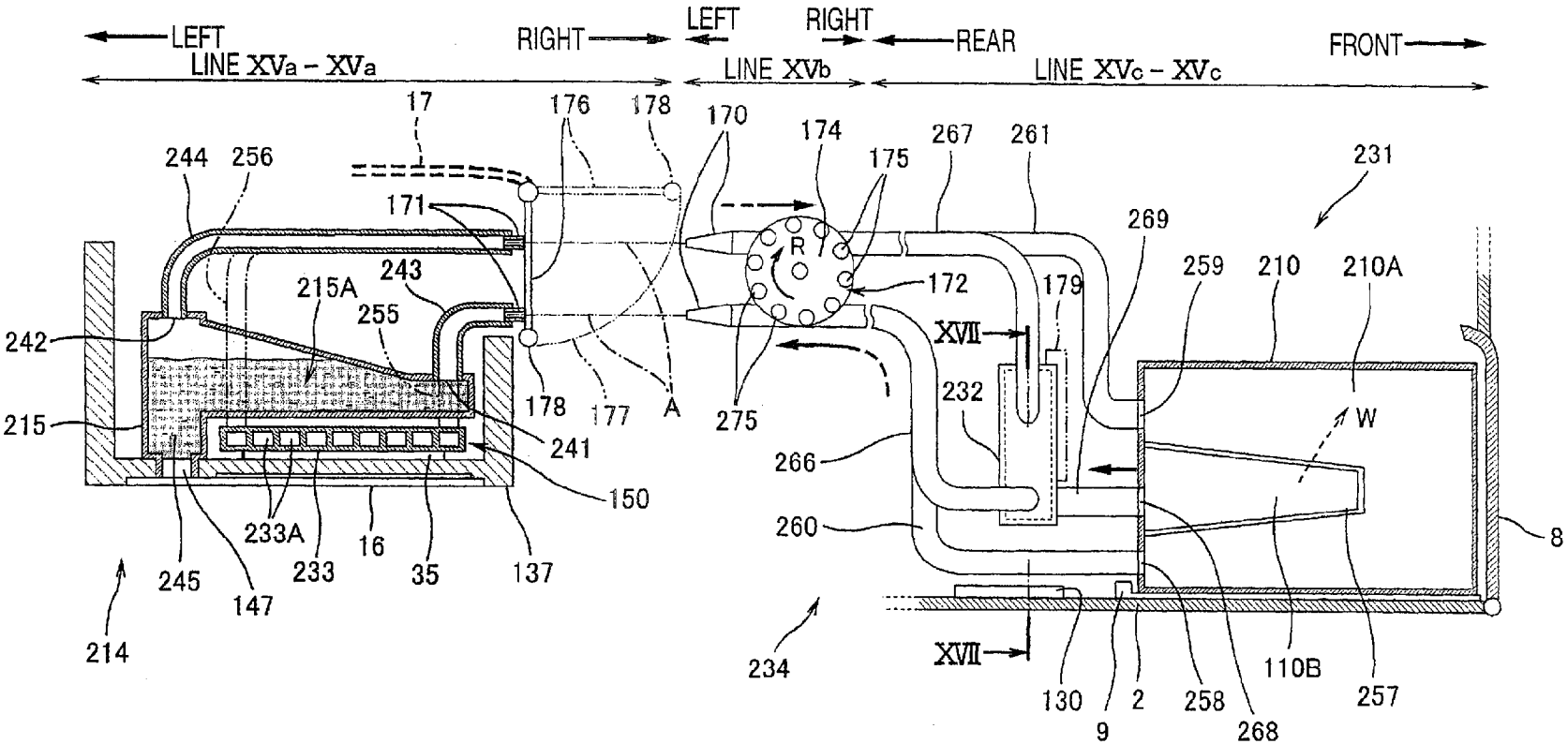
FIG. 15 is a cross-sectional view illustrating structures of an image recording unit, an ink refill portion, and a coolant replacement portion according to the third exemplary embodiment taken along the lines XVa-XVa, XVb, and XVc-XVc of FIG. 14.
Figure 16:
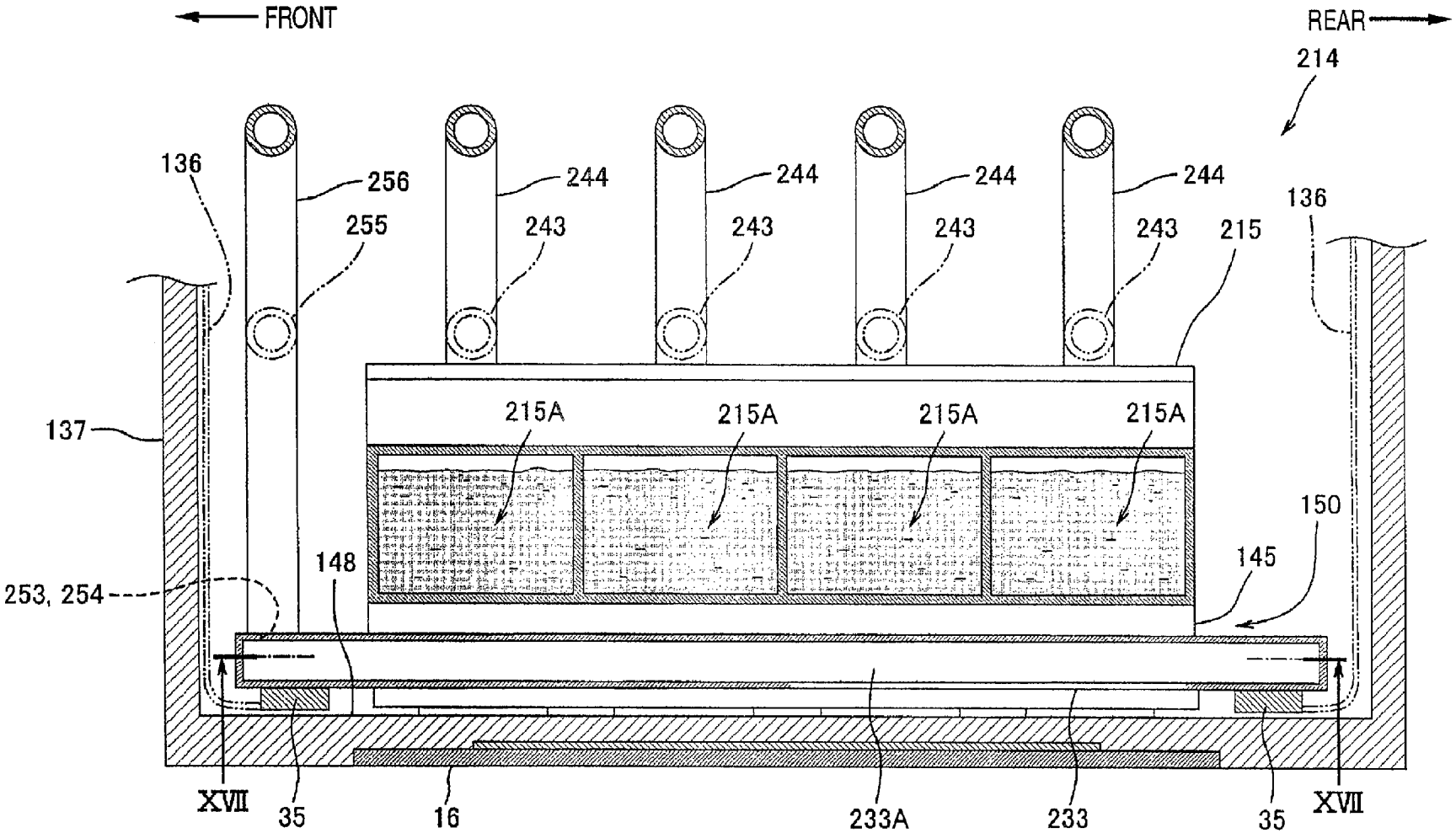
FIG. 16 is a cross-sectional view illustrating the structure of the image recording unit according to the third exemplary embodiment taken along the line XVI-XVI of FIG. 14.

FIG. 14 is a plan view schematically illustrating the structure of the printer unit 203. FIG. 15 is a cross-sectional view taken along the lines XVa-Xva, XVb, and XVc-XVc of FIG. 14, and shows the structures of an image recording unit 214, an ink refill portion 231, and a coolant replacement portion 234. FIG. 16 is a cross-sectional view taken along the line XVI-XVI of FIG. 14, and shows the structure of the image recording unit 214. The views shown in FIGS. 14 to 16 correspond to the views shown in FIGS. 9 to 11 illustrating the second exemplary embodiment, respectively.

As shown in FIG. 14, the positional relationship among the platen 13, the maintenance mechanism 129, the liquid waste foam 130, and the cartridge mounting portion 9, and the positional relationship among the ink discharge position, the maintenance position, and the ink refill position are the same as those in the second exemplary embodiment shown in FIGS. 9 to 11.

As shown in FIGS. 14 to 16, four sub ink tanks 215, a sub coolant tank 233, an IC chip 35, and a discharge head 16 are provided in a head holder 137 of the image recording unit 214 in a similar arrangement as that in the second exemplary embodiment. The sub coolant tank 233 is effectively arranged in a space 150 that is formed by the ink refill portion 145. The outer shapes of the sub ink tank 215 and the sub coolant tank 233 and the shape of a sub ink chamber 215A are the same as those in the second exemplary embodiment.

As shown in FIG. 15, a sub ink inlet 241 that allows the sub ink chamber 215A to communicate with the outside is provided in the upper right surface of the sub ink tank 215, and a sub ink outlet 242 that allows the sub ink chamber 215A to communicate with the outside is provided in the upper left surface of the sub ink tank 215. The sub ink inlet 241 is connected to a sub ink supply tube 243 that extends to the right side of the sub ink tank 215, and the sub ink outlet 242 is connected to a sub ink collecting tube 244 that is provided above the sub ink supply tube 242 so as to extend to the right side.

Figure 17:
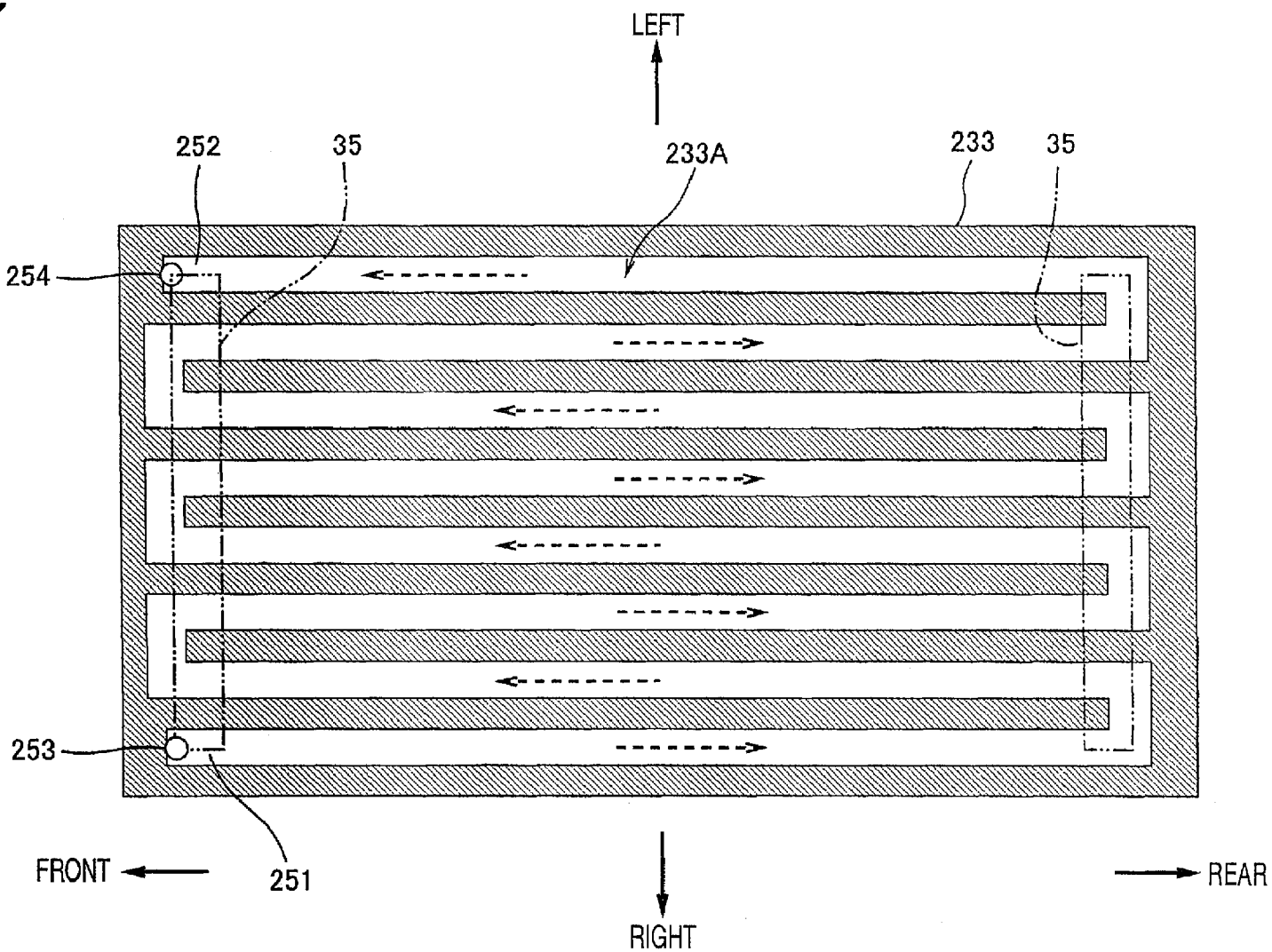
FIG. 17 is a cross-sectional view illustrating a structure of a sub coolant tank according to the third exemplary embodiment taken along the line XVII-XVII of FIG. 16.

FIG. 17 is a cross-sectional view illustrating the sub coolant tank 233 taken along the line XVII-XVII of FIG. 16. In FIG. 17, the positional relationship between the IC chip 35 and the sub coolant tank 233 in plan view is represented by a two-dot chain line. As shown in FIG. 17, a sub coolant chamber 233A having a labyrinth structure is provided in the sub coolant tank 233. A leading end 251 of the sub coolant chamber 233A is formed in the front right portion of the sub coolant tank 233, and a trailing end 252 is formed in the front left portion of the sub coolant tank 233. The sub coolant tank 233 includes a sub coolant inlet 253 that is formed at the leading end 251 of the sub coolant chamber 233A and communicates with the outside, and a sub coolant outlet 254 that is formed at the trailing end 252 of the sub coolant chamber 233A and communicates with the outside.

As shown in FIG. 16, the rear portion of the sub coolant tank 233 in which the sub coolant inlet 253 and the sub coolant outlet 254 are formed protrudes backward from the space 150. The sub coolant inlet 253 is connected to a sub coolant supply tube 255 that extends in the right-left direction with the same height as that of the sub ink supply tube 243 (which is represented by a two-dot chain line in FIGS. 15 and 16). The sub coolant outlet 254 is connected to a sub coolant collecting tube 256 that extends in the right-left direction with the same height as that of the sub ink supply tube 244 above the sub coolant supply tube 255 (which is represented by a solid line in FIGS. 14 and 16 and a two-dot chain line in FIG. 15).

As shown in FIG. 15, a main ink chamber 210A (liquid reservoir) that stores ink and a coolant refill chamber 110B (coolant reservoir) that can store a coolant are formed inside the ink cartridge 210. These two chambers 210A and 110B are divided by a partition wall 157 that is formed of a material having water permeability. A main ink outlet 258 that allows the main ink chamber 210A to communicate with the outside is provided in the bottom and the rear surface of the ink cartridge 210, and a main ink inlet 259 that allows the main ink chamber 210A to communicate with the outside is provided in the upper and rear surfaces of the ink cartridge 210. A main ink supply tube 260 is connected to the main ink outlet 258, and a main ink collecting tube 261 is connected to the main ink inlet 259.

As shown in FIG. 14, the main ink supply tube 260 and the main ink collecting tube 261 are arranged in the up-down direction so as to overlap each other in plan view. The tubes 260 and 261 extend backward and are then curved on the right side. Then, the tubes extend backward to pass the right side of the guide rail 23, and are then curved on the left side to be disposed between the right ends of the two guide rails 22 and 23 in the front-back direction.

Figure 18:
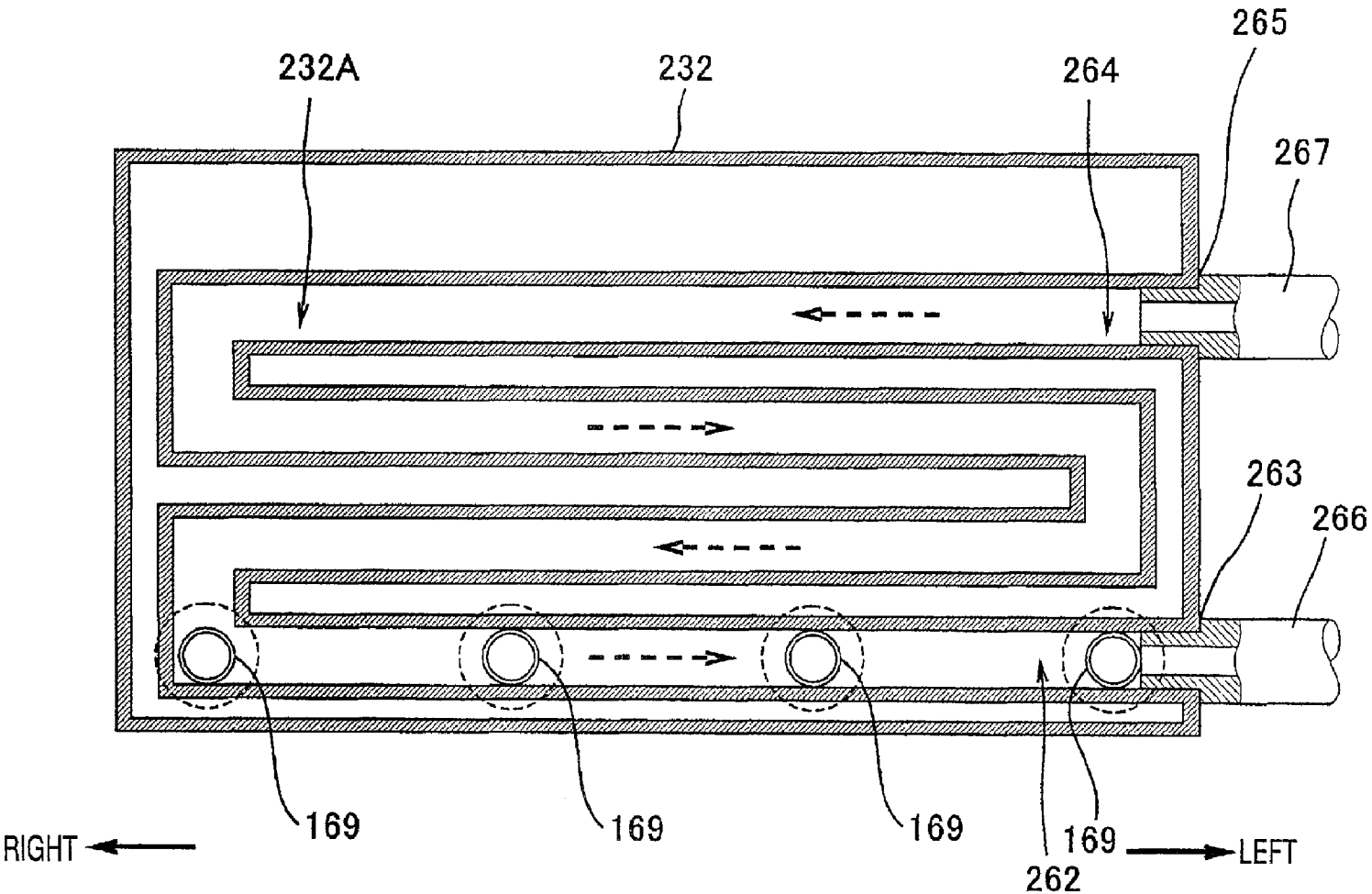
FIG. 18 is a cross-sectional view illustrating a structure of a main coolant tank according to the third exemplary embodiment taken along the line XVIII-XVIII of FIG. 15.

FIG. 18 is a cross-sectional view illustrating the main coolant tank 232 taken along the line XVIII-XVIII of FIG. 15. As shown in FIG. 18, a main coolant chamber 232A having a labyrinth structure is formed in the main coolant tank 232. A main coolant outlet 263 that allows one end portion 262 of the main coolant chamber 232A to communicate with the outside is provided in the bottom left portion of the main coolant tank 232, and a main coolant inlet 265 that allows the other end portion 264 of the main coolant chamber 232A to communicate with the outside is provided in the upper left portion of the main coolant tank 232. A main coolant supply tube 266 is connected to the main coolant outlet 263, and a main coolant collecting tube 267 is connected to the main coolant inlet 265. As shown in FIG. 14, the main coolant supply tube 266 and the main coolant collecting tube 267 are arranged in the up-down direction so as to overlap each other in plan view. That is, the tubes 266 and 267 extend backward and are then curved on the right side. Then, the tubes extend backward to pass the right side of the guide rail 23, and are then curved on the left side to be disposed between the right ends of the two guide rails 22 and 23 in the front-back direction.

As shown in FIGS. 15 and 18, a refill coolant outlet 168 that allows the ink refill chamber 110B to communicate with the outside is formed in the front surface of the ink cartridge 210, and the outlet 168 is connected to a coolant refill tube 169 that communicates with the main coolant chamber 232A of the main coolant tank 232.

As shown in FIG. 16, a total of five tubes, i.e., four sub ink supply tubes 243 and a sub coolant supply tube 254, are provided substantially at an equal interval in the front-back direction, and the sub ink supply tubes 243 and the sub coolant supply tubes 254 are also provided substantially at an equal interval in the front-back direction.

As shown in FIGS. 14 and 15, the open ends of the main ink supply tubes 260 and the main coolant supply tube 266 are provided substantially at an equal interval in the front-back direction, and the open ends of the main ink collecting tubes and the main coolant collecting tube are also arranged substantially at an equal interval in the front-back direction. As represented by a one-dot chain line A, the end of the main tube and the end of the sub tube are arranged so as to be opposite to each other in the right-left direction, which is the scanning direction of the carriage 17.

Tapered needle portions 170 having a conical shape are provided at the ends of the main tubes 260, 261, 266, and 267. Ring-shaped seals 171 that are formed of an elastic material, such as rubber, are inserted into the ends of the sub tubes 243, 244, 255, and 256.

A tube pump 172 is provided between the right ends of the two guide rails 22 and 23. The tube pump 172 is arranged between the main supply tubes 260 and 266 and the main collecting tubes 261 and 267 in the up-down direction. When the drum portion 174 is rotated, the indenters 175 are rotated while pressing the main tubes 260, 261, 266, and 267. Then, the internal pressure of each of the tubes varies, which causes the ink or the coolant in the tube to be transported.

A cover 176 is swingably attached to the right side of the carriage 17 of the image recording unit 214. When the cover 176 is disposed at a closed position where the cover is vertical to the swing shaft in the downward direction, which is represented by a solid line, due to its own weight, the seals 171 provided at the ends of the sub tubes 243, 244, 255, and 256 are closely adhered to the left surface of the cover 176, and the sub tubes 243, 244, 255, and 256 are closed. When the cover 176 is moved to the ink discharge position by an opening mechanism including the cam plate 176 and the cam follower 176, the cover 176 swings from the closed position to the opened position.

In the third exemplary embodiment, among the above-mentioned components, the ink refill portion 231 includes the ink cartridge 210 having the main ink chamber 210A, the main and sub ink supply tubes 260 and 243, the main and sub ink collecting tubes 261 and 244, the tube pump 172, and the tube pump driving circuit 199 (see FIG. 12). Among the above-mentioned components, the coolant replacement unit 234 includes the main coolant tank 232 having the main coolant chamber 232A, the main and sub coolant supply tubes 266 and 255, the main and sub coolant collecting tubes 267 and 256, the ink cartridge 210 having a coolant refill chamber 110B, the coolant refill tube 169, the tube pump 172, and the tube pump driving circuit 199.

In the third exemplary embodiment, as represented by a dashed arrow W in FIG. 15, water, which is the solvent of the coolant stored in the coolant refill chamber 110B, can be permeated into the main ink chamber 210A through the partition wall 157 due to osmotic pressure generated by a difference in concentration between the water and the coolant. Therefore, it is possible to maintain the viscosity of ink substantially at a constant level for a long time.

Figure 19:
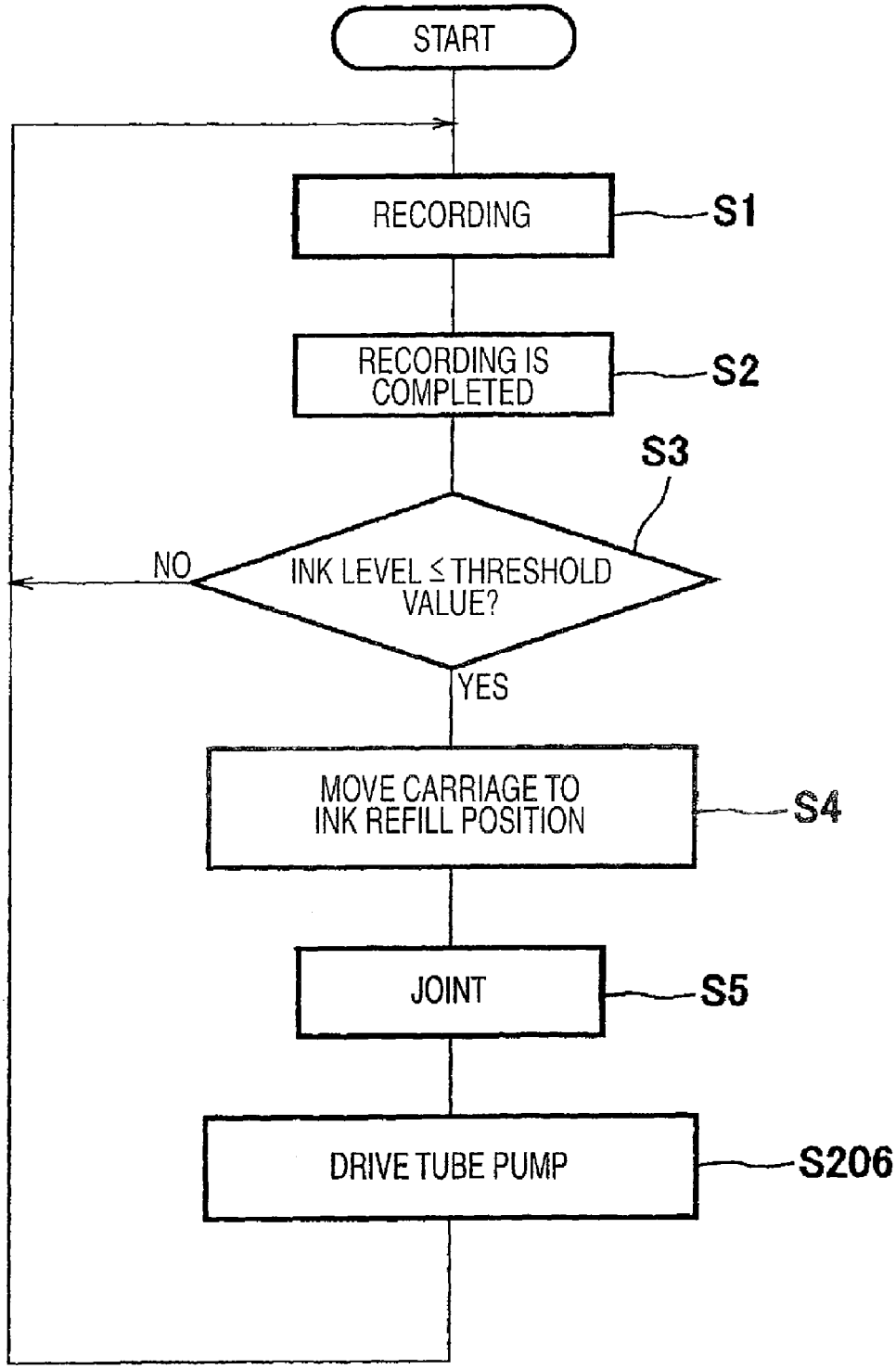
FIG. 19 is a flowchart illustrating operation of the printer unit related to an ink refill process and a coolant replacement process according to the third exemplary embodiment.
Figure 20:
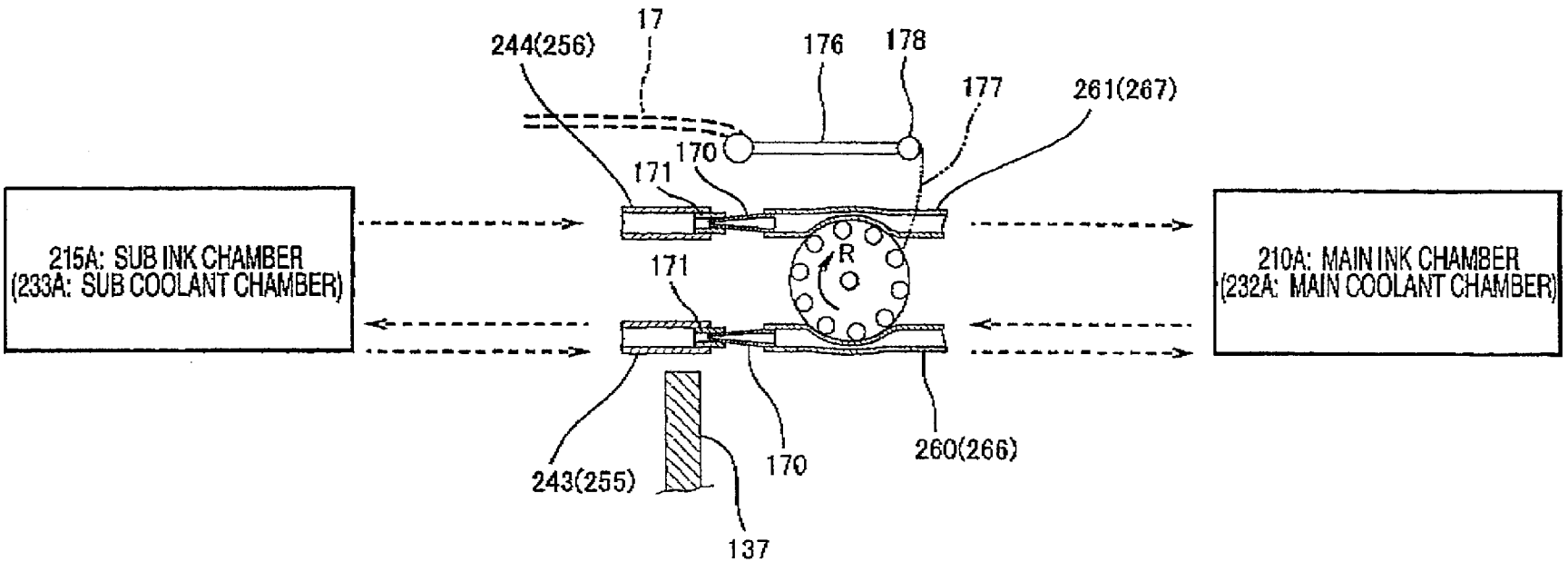
FIG. 20 is a cross-sectional view illustrating states of ends of tubes during the coolant replacement process according to the third exemplary embodiment.

The control unit 296 of the multi-function machine 1 provided with the printer unit 203 has the same structure as the control unit 196 according to the second exemplary embodiment shown in FIG. 13. FIG. 19 is a flowchart illustrating the operation of the multi-function machine 1 (the printer unit 203) related to an ink refill process and a coolant replacement process that are performed by the control unit 296. FIG. 20 is a cross-sectional view illustrating the states of the ends of the tubes when the carriage 17 is disposed at the ink refill position.

As shown in FIG. 19, the printer unit 203 records an image on a recording sheet (Operation S1). When the recording of an image on the recording sheet is completed (Operation S2), the printing unit 203 determines whether the ink level of the sub ink tank 215 is lower than a threshold value on the basis of the measured result of the ink level (Operation S3). This determination may be obtained by software.

When the carriage 17 is disposed at the ink discharge position, the ink cartridge 210 does not communicate with the sub ink tank 215, and the main coolant tank 232 does not communicate with the sub coolant tank 233. The sub tubes 243, 244, 255, and 256 are closed by the cover 176, and the main tubes 260, 261, 266, and 267 are pressed by the indenters 175 of the tube pump 172. Therefore, no ink or coolant leaks from the main and sub tubes to the inside of the housing 2.

Heat generated from the IC chip 35 when an image is recorded is absorbed by the coolant stored in the sub coolant tank 233 that is provided immediately above the IC chip 35. Therefore, it is possible to prevent an increase in the surrounding temperature of the discharge head 16. Since the heat of the coolant in the main coolant tank 232 is consumed as the latent heat of evaporation of the liquid waste foam 130, the coolant in the main coolant tank 232 is effectively cooled down.

In Operation S3, if it is determined that the value indicating the ink level is larger than the threshold value, the printing unit returns to Operation S1 to record an image on the next recording sheet. On the other hand, if it is determined that the value indicating the ink level is less than or equal to the threshold value, the printing unit drives the carriage motor 28 to move the carriage 17 to the ink refill position (Operation S4).

In the second exemplary embodiment, while the carriage 17 is moved from the ink discharge position to the ink refill position, the cam follower 178 slides on the cam surface of the cam plate 177. Then, the cover 176 swings up to the opened position, and the sub tubes 243, 244, 255, and 256 are opened to the right side. In this state, when the carriage 17 is moved up to the ink refill position, as shown in FIG. 20, the needle portions 170 attached to the ends of the main tubes 260, 261, 266, and 267 are inserted into the seals 171 of the corresponding sub tubes 243, 244, 255, and 256 so as to tightly mate with the inner circumferential surfaces of the seals 171.

In this way, the main ink chamber 210A and the sub ink chamber 215A communicate with each other through two paths including the ink supply tubes 260 and 243 and the ink collecting tubes 261 and 244. The main coolant chamber 232A and the sub coolant chamber 233A communicate with each other through two paths including the coolant supply tubes 266 and 255 and the coolant collecting tubes 267 and 256 (Operation S5). Therefore, in the third exemplary embodiment, the ink refill portion 231 and the coolant replacement portion 234 are configured such that the main and sub sides automatically communicate with each other by moving the carriage 17 to the ink refill position.

When the two ink chambers 210A and 215A communicate with each other and the two coolant chambers 232A and 233A communicate with each other, the tube pump 172 is driven. In this case, as represented by an arrow R in FIG. 20, the drum portion 174 of the tube pump 172 is rotated in the clockwise direction in a front view. Then, the ink in the ink tubes 260 and 243 flows from the main ink chamber 210A to the sub ink chamber 215A, and the ink in the ink collecting tubes 261 and 244 flows from the sub ink chamber 215A to the main ink chamber 210A. In addition, the coolant in the coolant supply tubes 266 and 255 flows from the main coolant chamber 232A to the sub coolant chamber 233A, and the coolant in the coolant collecting tubes 267 and 256 flows from the sub coolant chamber 233A to the main coolant chamber 232A (Operation S206).

As represented by a dashed arrow in FIG. 18, a coolant flows into the main coolant chamber 232A of the main coolant tank 232 through the main coolant inlet 265 and then flows from one end 264 to the other end 262. Then, the coolant flows out from the main coolant outlet 263. In addition, as represented by a dashed arrow in FIG. 17, a coolant flows into the sub coolant chamber 233A of the sub coolant tank 233 through the sub coolant inlet 253 and then flows from the leading end 251 to the trailing end 252. Then, the coolant flows out from the sub coolant outlet 254. The main coolant chamber 232A and the sub coolant chamber 233A are fully filled with a coolant in advance. In the third exemplary embodiment, when the tube pump 172 is driven, the coolant replacement portion 234 simultaneously performs a process of collecting the coolant whose temperature is increased in the sub coolant chamber 233A and a process of supplying the coolant in the main coolant chamber 232A to replace the coolant in the sub coolant chamber 233A. When the coolant is evaporated, the tube pump 172 is driven to supply the coolant stored in the coolant refill chamber 210B to the main coolant chamber 232A through the coolant refill tube 169. In this way, the main coolant chamber 232A or the sub coolant chamber 233A is kept full.

Therefore, since the coolant replacement portion 234 replaces a coolant using the tube pump 172, the sub coolant chamber 233A is filled with the cooled coolant.

Meanwhile, as shown in FIG. 15, the sub ink outlet 242 is provided at the highest position of the sub ink chamber 215A, and the sub ink inlet 241 is provided below the sub ink outlet 242. Therefore, when the tube pump 272 is driven, ink is supplied from the main ink chamber 210A to the sub ink chamber 215A through the sub ink inlet 241. Until the sub ink chamber 215A is fully filled with the ink, the ink in the sub ink chamber 215A is not collected to the main ink chamber. Therefore, the sub ink chamber 215A where the ink level is low is rapidly filled with ink. In third exemplary embodiment, the amount of ink remaining in the four sub ink chambers 215A is kept constant at all times, but the invention is not limited thereto. For example, when only a sub ink chamber 215A is fully filled with ink, the ink supply process and the ink collecting process are simultaneously performed on the sub ink chamber 215A, and the sub ink chamber 215A is fully filled with ink at all times. Meanwhile, the ink refill process is continuously performed on the other sub ink chambers 215A that are not filled with ink until the chambers are fully filled with ink.

As described above, in the third exemplary embodiment, the ink refill portion 231 uses a single tube pump 172 to absorb a variation in the amount of remaining ink, thereby refilling all the sub ink chambers 215A with ink.

When the ink refill process and the ink replacement process are completed, the printing unit returns to Operation S1 to resume the recording of an image on the next recording sheet.

As described above, in the printer unit 203 according to the third exemplary embodiment, when the carriage 17 is disposed at the ink discharge position, a path for circulating a coolant is closed, and when the carriage 17 is disposed at the ink refill position, the path is opened. Therefore, it is possible to achieve a structure for water-cooling around the carriage 17 while reducing the overall size of a device. In addition, the value that uses the driving force of the carriage 17 to open the path and uses urging force to close the path is omitted, and the tube pump and the cover that is swingably provided are used. Therefore, it is possible to reduce the sizes of the coolant replacement portion 234 and the ink refill portion 231.

Further, since the coolant supply process and the coolant replacement process are simultaneously performed, it is possible to reduce the time used to replace the coolant in the sub coolant tank 233. In addition, since a single tube pump 172 is used to perform four operations, such as a coolant supply operation, a coolant collecting operation, an ink supply operation, and an ink collecting operation, it is possible to reduce the sizes of the coolant replacement portion 234 and the ink refill portion 231.

The liquid discharging device according to the invention is not limited to the structures of the above-described exemplary embodiments, but various modifications and changes of the invention can be made. For example, in the first exemplary embodiment, when the lift device 64 is operated to lift up five joint valves 61 and 91, the valve bodies 62 and 92 of the joint valves simultaneously come into contact with the valve bodies 48 and 76 of the corresponding refill port valves 47 and 75, and five sets of the joint valves 61 and 91 and the refill port valves 47 and 75 are opened at the same time. Therefore, the lift device 64 outputs a driving force corresponding to the sum of the urging forces of the coil springs of five refill port valves and five joint valves. As a modification, the lengths of the valve bodies 62 and 92 of the joint valves 61 and 91 that protrude upward may be different from each other, the valve bodies 62 and 92 may come into contact with the valve bodies 48 and 76 of the corresponding refill port valves 47 and 75 at different timings such that the opening timings of the valves are different from each other, and the timing when the ink cartridge 10 and the sub ink tank 15 communicate with each other may be different from the timing when the main coolant tank 32 and the sub coolant tank 33 communicate with each other. In this case, the lift device 64 outputs only the driving force used to open one set of the refill port valve and the joint valve to sequentially open the valves. A plurality of lift devices may alternatively be provided such that the timings when the valves are opened are different from each other.

In the second and third exemplary embodiments, similar to the first exemplary embodiment, the main tubes may be arranged such that the ends thereof deviate from each other in the right-left direction, and the timing when the main ink chamber and the sub ink chamber communicate with each other may be different from the timing when the main coolant chamber and the sub coolant chamber communicate with each other. In this case, even when the driving force of the carriage 17 is low, it is possible to connect or disconnect the tubes.

In the above-described exemplary embodiments, when the ink level is lower than a threshold vale, the ink supply process and the coolant replacement process are performed, but the invention is not limited thereto. For example, it is assumed that, when an amount of time has elapsed after the replacement of a coolant, the coolant is naturally dried and evaporated, and the amount thereof is reduced. Therefore, coolant replacement may be performed regardless of the ink level.

The invention can be applied to any type of liquid discharging devices including a so-called station supply type that supplies a liquid from a main liquid tank storing a liquid to a liquid discharge head as well as an ink jet printer.

As described above, there is provided a liquid discharging device. The discharging device includes a discharge head that discharges a liquid; a carriage that is movable and holds the discharge head; a sub liquid tank that is held by the carriage and stores the liquid supplied to the discharge head; a liquid refill portion that refills the sub liquid tank with the liquid and includes a main liquid tank that can communicate with the sub liquid tank; a carriage movement control unit that moves the carriage within a range including a liquid discharge position where the discharge head discharges the liquid onto a recording medium and a liquid refill position where the sub liquid tank communicates with the main liquid tank; a liquid refill control unit that controls the operation of the liquid refill portion; a sub coolant tank that is held by the carriage and stores a coolant for cooling the discharge head; and a coolant replacement portion that includes a main coolant tank which can communicate with the sub coolant tank, and replaces the coolant in the sub coolant tank with a coolant in the main coolant tank when the main coolant tank communicates with the sub coolant tank. The sub coolant tank does not communicate with the main coolant tank when the carriage is disposed at the liquid discharge position, and the sub coolant tank communicates with the main coolant tank when the carriage is disposed at the liquid refill position.

According to the above-mentioned structure, when the carriage is disposed at the liquid discharge position and the discharge head discharges a liquid, the main coolant tank and the sub coolant tank do not communicate with each other. When the carriage is disposed at the liquid refill position, they communicate with each other. In the communicating state, the coolant replacement portion is operated to replace the coolant in the sub coolant tank with the coolant in the main coolant tank. As such, in the station-supply-type liquid discharging device, it is not necessary to provide a coolant circulating path that is connected to the carriage at all times. It is possible to cool around the discharge head without increasing the size of a device.

In the liquid discharging device according to the above-mentioned aspect, the coolant replacement portion may include first and second coolant paths that are independently provided and allow the main coolant tank to communicate with the sub coolant tank when the carriage is disposed at the liquid refill position. The coolant replacement portion may collect the coolant from the sub coolant tank into the main coolant tank through the first coolant path, and supplies the coolant from the main coolant tank to the sub coolant tank through the second coolant path. According to this structure, it is possible to replace the coolant in the sub coolant tank in a short time.

In the liquid discharging device according to the above-mentioned aspect, the coolant replacement portion may include a coolant path that allows the main coolant tank to communicate with the sub coolant tank when the carriage is disposed at the liquid refill position, and the coolant replacement portion may collect the coolant from the sub coolant tank into the main coolant tank and supplies the coolant from the main coolant tank to the sub coolant tank through the coolant path. According to this structure, it is possible to simplify the structure of the coolant replacement portion and reduce a space for arranging the coolant path.

In the liquid discharging device according to the above-mentioned aspect, the liquid refill portion may include a liquid pump unit that performs a liquid collecting operation of moving the liquid in the sub liquid tank to the main liquid tank and a liquid supply operation of moving the liquid in the main liquid tank to the sub liquid tank. The coolant replacement portion may also include a coolant pump unit that performs a coolant collecting operation of moving the coolant in the sub coolant tank to the main coolant tank and a coolant supply operation of moving the coolant in the main coolant tank to the sub coolant tank. The liquid pump unit and the coolant pump unit may also be integrally formed, may simultaneously perform the liquid collecting operation and the coolant collecting operation, and may simultaneously perform the liquid supply operation and the coolant supply operation. According to this structure, it is possible to simplify the structures of the liquid refill portion and the coolant replacement portion.

In the liquid discharging device according to the above-mentioned aspect, the coolant pump unit may be a tube pump. According to this structure, it is possible to reduce the size of the coolant pump unit.

In the liquid discharging device according to the above-mentioned aspect, when the carriage is moved to the liquid refill position, there may be a difference in timing between when the sub liquid tank communicates with the main liquid tank and the timing when the sub coolant tank communicates with the main coolant tank. According to this structure, it is possible to distribute the driving force used to open or close the liquid or coolant path. As a result, a small driving force is used to open or close the path between the main liquid tank and the sub liquid tank and the path between the main coolant tank and the sub coolant tank.

The liquid discharging device according to the above-mentioned aspect may further include a sub liquid tube that is held by the carriage so as to be connected to the sub liquid tank, with its opening facing the liquid refill position in a direction in which the carriage is reciprocated; a sub coolant tube that is held by the carriage so as to be connected to the sub coolant tank, with its opening facing the liquid refill position in the direction in which the carriage is reciprocated; a main liquid tube that is connected to the main liquid tank and is opposite to the sub liquid tube in the direction in which the carriage is reciprocated; and a main coolant tube that is connected to the main coolant tank and is opposite to the sub coolant tube in the direction in which the carriage is reciprocated. When the carriage is disposed at the liquid refill position, the sub coolant tube and the main coolant tube opposite to each other are connected, and the sub liquid tube and the main liquid tube opposite to each other are connected. According to this structure, when the carriage is disposed at the liquid refill position, the tubes are automatically connected to each other. Therefore, it is not necessary to provide special mechanisms for closing or opening the path between the main tank and the sub tank in the liquid refill portion and the coolant replacement portion, and/or it is not necessary to perform special control processes for closing or opening the path on the liquid refill portion and the coolant replacement portion. In addition, since the path between the main tank and the sub tank is opened or closed by a mechanical operation of connecting or disconnecting the tubes, it is possible to reduce a driving force used to open or close the path, as compared to the structure in which the urging force of a spring is used to close the path between the main tank and the sub tank. As a result, it is possible to simplify the structures of the liquid refill portion and the coolant replacement portion.

The liquid discharging device according to the above-mentioned aspect may further include a cover that is swingably attached to the carriage, and that closes the sub liquid tube and the sub coolant tube when the carriage is separated from the liquid refill position; and an opening mechanism that moves the cover to open the sub liquid tube and the sub coolant tube, when the carriage is moved to the liquid refill position. According to this structure, when the carriage is disposed at the liquid discharge position where ink refill or coolant replacement is not performed, the sub tube is closed. Therefore, when the liquid is being discharged, it is possible to prevent the leakage of a liquid or a coolant from the tube.

In the liquid discharging device according to the above-mentioned aspect, the main coolant tank may be a radiator. According to this structure, the main coolant tank has both a function of storing the coolant and a function of cooling the coolant. Therefore, it is possible to supply a cooled coolant to the sub coolant tank and reduce the size of a liquid discharging device.

The liquid discharging device according to the above-mentioned aspect may further include a liquid waste foam that absorbs the liquid discharged from the discharge head, and the main coolant tank may be arranged adjacent to the liquid waste foam. According to this structure, the heat of the coolant in the main coolant tank is dissipated by the liquid absorbed by the liquid waste foam. Therefore, it is possible to effectively cool the coolant. In addition, since the evaporation of the liquid absorbed by the liquid waste foam is accelerated, it is possible to reduce the volume of the liquid waste foam and reduce a space for arranging the liquid waste foam.

In the liquid discharging device according to the above-mentioned aspect, the main liquid tank may include a liquid reservoir that stores the liquid and a coolant reservoir that stores the coolant, and the coolant reservoir communicates with the main coolant tank while the main liquid tank is mounted to a main body. According to this structure, for example, even when the coolant is evaporated, it is possible to refill the main coolant tank with the coolant in the coolant reservoir. As a result, it is possible to circulate the coolant for a long time.

In the liquid discharging device according to the above-mentioned aspect, a solvent of the liquid may be the same as that of the coolant, the concentration of the coolant may be lower than that of the liquid, and the main tank may include a partition wall between the liquid reservoir and the coolant reservoir. At least a portion of the partition wall may be liquid-permeable, and the solvent of the coolant stored in the coolant reservoir can be infiltrated into the liquid reservoir through the partition wall. According to this structure, for example, even when the solvent of the liquid is evaporated, it is possible to prevent the solvent of the coolant from permeating the partition wall. As a result, it is possible to prevent an increase in the viscosity of the liquid.

In the liquid discharging device according to the above-mentioned aspect, the coolant may include glycerin. According to this structure, it is possible to increase the melting point of the coolant. As a result, it is possible to effectively cool the discharge head and thus to prevent the evaporation of the coolant.

In the liquid discharging device according to the above-mentioned aspect, the coolant may include a phase-change material. According to this structure, when the coolant in the sub coolant tank cools the discharge head, a temperature variation around a phase-change temperature is reduced. Therefore, it is possible to reduce the volume of the sub coolant tank. In this way, it is possible to reduce the size of a carriage and the amount of coolant replaced. As a result, it is possible to shorten the time until coolant replacement.

In the liquid discharging device according to the above-mentioned aspect, the discharge head may be arranged below a lower surface of the sub liquid tank, and communicate with the sub liquid tank through a liquid remaining portion that protrudes downward from the lower surface and that has an amount of liquid remaining therein at all times. The sub coolant tank may be arranged in a space between the sub liquid tank and the discharge head. According to this structure, when the amount of liquid remaining in the sub liquid tank is reduced or when the liquid is collected to refill the liquid, it is possible to prevent air from permeating the discharge head using the liquid in the liquid remaining portion. In this case, a space corresponding to the height of the liquid remaining portion in the up-down direction is formed between the sub liquid tank and the discharge head so as to be adjacent to the liquid remaining portion. Since the sub coolant tank is arranged in the space, it is possible to effectively use a dead space.

According to the liquid discharging device of the invention, a structure for cooling around the discharge head is provided in the station-supply-type liquid discharging device, and when the carriage is disposed at the liquid refill position, the coolant in the sub coolant tank that is provided in the carriage is replaced. Therefore, the overall size of a device does not increase. That is, it is possible to provide a device capable of cooling a liquid with a coolant while maintaining the advantage of the station supply type.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. A liquid discharging device comprising:

a discharge head that discharges a liquid;

a carriage that is movable and holds the discharge head;

a sub liquid tank that is held by the carriage and stores the liquid which is supplied to the discharge head;

a liquid refill portion that refills the sub liquid tank with the liquid and that comprises a main liquid tank that can communicate with the sub liquid tank;

a carriage movement control unit that moves the carriage within a range comprising a liquid discharge position at which the discharge head discharges the liquid onto a recording medium and a liquid refill position at which the sub liquid tank communicates with the main liquid tank;

a liquid refill control unit that controls the operation of the liquid refill portion;

a sub coolant tank that is held by the carriage and stores a coolant for cooling the discharge head; and a coolant replacement portion that comprises a main coolant tank which can communicate with the sub coolant tank, and replaces the coolant in the sub coolant tank with a coolant in the main coolant tank when the main coolant tank communicates with the sub coolant tank, wherein the sub coolant tank does not communicate with the main coolant tank when the carriage is disposed at the liquid discharge position, and the sub coolant tank communicates with the main coolant tank when the carriage is disposed at the liquid refill position, and wherein the coolant replacement portion comprises a coolant path that allows the main coolant tank to communicate with the sub coolant tank, when the carriage is disposed at the liquid refill position, and the coolant replacement portion collects the coolant from the sub coolant tank into the main coolant tank and supplies the coolant from the main coolant tank to the sub coolant tank through the coolant path.

2. The liquid discharging device according to claim 1, wherein, when the carriage is moved to the liquid refill position, there is a difference between a timing when the sub liquid tank communicates with the main liquid tank and a timing when the sub coolant tank communicates with the main coolant tank.

3. The liquid discharging device according to claim 1, further comprising:

a sub liquid tube that is held by the carriage so as to be connected to the sub liquid tank, with an opening of the sub liquid tube facing the liquid refill position in a direction in which the carriage is reciprocated;

a sub coolant tube that is held by the carriage so as to be connected to the sub coolant tank, with an opening of the sub coolant tank facing the liquid refill position in the direction in which the carriage is reciprocated;

a main liquid tube that is connected to the main liquid tank and is opposite to the sub liquid tube in the direction in which the carriage is reciprocated; and a main coolant tube that is connected to the main coolant tank and is opposite to the sub coolant tube in the direction in which the carriage is reciprocated, wherein, when the carriage is disposed at the liquid refill position, the sub coolant tube and the main coolant tube which are opposed to each other, are connected, and the sub liquid tube and the main liquid tube which are opposed to each other, are connected.

4. The liquid discharging device according to claim 1, wherein the main coolant tank is a radiator.

5. The liquid discharging device according to claim 1, further comprising:

a liquid waste foam that absorbs the liquid discharged from the discharge head, wherein the main coolant tank is arranged adjacent to the liquid waste foam.

6. The liquid discharging device according to claim 1, wherein the main liquid tank comprises:

a liquid reservoir that stores the liquid; and a coolant reservoir that stores the coolant, and the coolant reservoir communicates with the main coolant tank while the main liquid tank is mounted to a main body.

7. The liquid discharging device according to claim 1, wherein the coolant comprises glycerin.

8. The liquid discharging device according to claim 1, wherein the coolant comprises a phase-change material.

9. The liquid discharging device according to claim 1, wherein the discharge head is arranged below a lower surface of the sub liquid tank, and communicates with the sub liquid tank through a liquid remaining portion that protrudes downward from the lower surface and has an amount of liquid remaining therein at all times, and the sub coolant tank is arranged in a space between the sub liquid tank and the discharge head.

10. A liquid discharging device comprising:

a discharge head that discharges a liquid;

a carriage that is movable and holds the discharge head;

a sub liquid tank that is held by the carriage and stores the liquid which is supplied to the discharge head;

a liquid refill portion that refills the sub liquid tank with the liquid and that comprises a main liquid tank that can communicate with the sub liquid tank;

a carriage movement control unit that moves the carriage within a range comprising a liquid discharge position at which the discharge head discharges the liquid onto a recording medium and a liquid refill position at which the sub liquid tank communicates with the main liquid tank;

a liquid refill control unit that controls the operation of the liquid refill portion;

a sub coolant tank that is held by the carriage and stores a coolant for cooling the discharge head; and a coolant replacement portion that comprises a main coolant tank which can communicate with the sub coolant tank, and replaces the coolant in the sub coolant tank with a coolant in the main coolant tank when the main coolant tank communicates with the sub coolant tank, wherein the sub coolant tank does not communicate with the main coolant tank when the carriage is disposed at the liquid discharge position, and the sub coolant tank communicates with the main coolant tank when the carriage is disposed at the liquid refill position, and wherein the coolant replacement portion comprises first and second coolant paths that are independently provided and allow the main coolant tank to communicate with the sub coolant tank, when the carriage is disposed at the liquid refill position, and the coolant replacement portion collects the coolant from the sub coolant tank into the main coolant tank through the first coolant path, and supplies the coolant from the main coolant tank to the sub coolant tank through the second coolant path.

11. A liquid discharging device comprising:

a discharge head that discharges a liquid;

a carriage that is movable and holds the discharge head;

a sub liquid tank that is held by the carriage and stores the liquid which is supplied to the discharge head;

a liquid refill portion that refills the sub liquid tank with the liquid and that comprises a main liquid tank that can communicate with the sub liquid tank;

a carriage movement control unit that moves the carriage within a range comprising a liquid discharge position at which the discharge head discharges the liquid onto a recording medium and a liquid refill position at which the sub liquid tank communicates with the main liquid tank;

a liquid refill control unit that controls the operation of the liquid refill portion;

a sub coolant tank that is held by the carriage and stores a coolant for cooling the discharge head; and a coolant replacement portion that comprises a main coolant tank which can communicate with the sub coolant tank, and replaces the coolant in the sub coolant tank with a coolant in the main coolant tank when the main coolant tank communicates with the sub coolant tank, wherein the sub coolant tank does not communicate with the main coolant tank when the carriage is disposed at the liquid discharge position, and the sub coolant tank communicates with the main coolant tank when the carriage is disposed at the liquid refill position, and wherein the liquid refill portion comprises a liquid pump unit that performs a liquid collecting operation of moving the liquid in the sub liquid tank to the main liquid tank and a liquid supply operation of moving the liquid in the main liquid tank to the sub liquid tank, the coolant replacement portion comprises a coolant pump unit that performs a coolant collecting operation of moving the coolant in the sub coolant tank to the main coolant tank and a coolant supply operation of moving the coolant in the main coolant tank to the sub coolant tank, and the liquid pump unit and the coolant pump unit are integrally formed, simultaneously perform the liquid collecting operation and the coolant collecting operation, and simultaneously perform the liquid supply operation and the coolant supply operation.

12. The liquid discharging device according to claim 11, wherein the coolant pump unit is a tube pump.

13. A liquid discharging device comprising:

a discharge head that discharges a liquid;

a carriage that is movable and holds the discharge head;

a sub liquid tank that is held by the carriage and stores the liquid which is supplied to the discharge head;

a liquid refill portion that refills the sub liquid tank with the liquid and that comprises a main liquid tank that can communicate with the sub liquid tank;

a carriage movement control unit that moves the carriage within a range comprising a liquid discharge position at which the discharge head discharges the liquid onto a recording medium and a liquid refill position at which the sub liquid tank communicates with the main liquid tank;

a liquid refill control unit that controls the operation of the liquid refill portion;

a sub coolant tank that is held by the carriage and stores a coolant for cooling the discharge head;

a coolant replacement portion that comprises a main coolant tank which can communicate with the sub coolant tank, and replaces the coolant in the sub coolant tank with a coolant in the main coolant tank when the main coolant tank communicates with the sub coolant tank, a sub liquid tube that is held by the carriage so as to be connected to the sub liquid tank, with an opening of the sub liquid tube facing the liquid refill position in a direction in which the carriage is reciprocated;

a sub coolant tube that is held by the carriage so as to be connected to the sub coolant tank, with an opening of the sub coolant tank facing the liquid refill position in the direction in which the carriage is reciprocated;

a main liquid tube that is connected to the main liquid tank and is opposite to the sub liquid tube in the direction in which the carriage is reciprocated;

a main coolant tube that is connected to the main coolant tank and is opposite to the sub coolant tube in the direction in which the carriage is reciprocated, a cover that is swingably attached to the carriage, and that closes the sub liquid tube and the sub coolant tube when the carriage is separated from the liquid refill position; and an opening mechanism that moves the cover to open the sub liquid tube and the sub coolant tube, when the carriage is moved to the liquid refill position, wherein the sub coolant tank does not communicate with the main coolant tank when the carriage is disposed at the liquid discharge position, and the sub coolant tank communicates with the main coolant tank when the carriage is disposed at the liquid refill position, and wherein, when the carriage is disposed at the liquid refill position, the sub coolant tube and the main coolant tube which are opposed to each other, are connected, and the sub liquid tube and the main liquid tube which are opposed to each other, are connected.

14. A liquid discharging device comprising:

a discharge head that discharges a liquid;

a carriage that is movable and holds the discharge head;

a sub liquid tank that is held by the carriage and stores the liquid which is supplied to the discharge head;

a liquid refill portion that refills the sub liquid tank with the liquid and that comprises a main liquid tank that can communicate with the sub liquid tank;

a carriage movement control unit that moves the carriage within a range comprising a liquid discharge position at which the discharge head discharges the liquid onto a recording medium and a liquid refill position at which the sub liquid tank communicates with the main liquid tank;

a liquid refill control unit that controls the operation of the liquid refill portion;

a sub coolant tank that is held by the carriage and stores a coolant for cooling the discharge head; and a coolant replacement portion that comprises a main coolant tank which can communicate with the sub coolant tank, and replaces the coolant in the sub coolant tank with a coolant in the main coolant tank when the main coolant tank communicates with the sub coolant tank, wherein the sub coolant tank does not communicate with the main coolant tank when the carriage is disposed at the liquid discharge position, and the sub coolant tank communicates with the main coolant tank when the carriage is disposed at the liquid refill position, wherein the main liquid tank comprises:

a liquid reservoir that stores the liquid; and a coolant reservoir that stores the coolant, and the coolant reservoir communicates with the main coolant tank while the main liquid tank is mounted to a main body, and wherein a solvent of the liquid is the same as a solvent of the coolant, a concentration of the coolant is lower than a concentration of the liquid, the main tank comprises a partition wall between the liquid reservoir and the coolant reservoir, and at least a portion of the partition wall is liquid-permeable such that the solvent of the coolant stored in the coolant reservoir can infiltrate into the liquid reservoir through the partition wall.

15. A liquid discharging device comprising:

a moveable carriage comprising:

a discharge head which discharges a liquid, a sub-liquid tank which stores the liquid for discharge, and a sub-coolant tank which stores a coolant for cooling the discharge head, the moveable carriage moving within a range comprising a discharge position at which the discharge head discharges the liquid onto a recording medium and a refill position at which the sub-liquid tank and the sub-coolant tank are refilled with the liquid and the coolant, respectively; and a refill unit comprising:

a main liquid tank, and a main coolant tank;

wherein the sub-liquid tank and the sub-coolant tank of the carriage and the main liquid tank and the main coolant tank of the stationary refill unit only communicate with each other, respectively, when the carriage is in the refill position, and wherein the refill unit comprises a partition wall between the main liquid tank and the main coolant tank, and at least a portion of the partition wall is liquid-permeable.

16. The liquid discharging device according to claim 15, wherein the moveable carriage further comprises an IC chip, and the sub-coolant tank further comprises a wall, the wall being provided adjacent to the IC chip and the discharging head.

17. The liquid discharging device according to claim 15, wherein the sub-coolant tank is provided between the sub-liquid tank and the discharge head.

* * * * *